United States Patent [19]

Ohara et al.

[11] 4,332,876

[45] Jun. 1, 1982

[54] ELECTROPHOTOGRAPHIC SCREEN

[75] Inventors: Katsunobu Ohara; Keiji Tanaka, both of Kawasaki; Yujiro Ando, Yokohama; Inao Moriyama, Ebina, all of Japan

[73] Assignee: Canon Kabushiki Kaisha, Tokyo, Japan

[21] Appl. No.: 162,654

[22] Filed: Jun. 24, 1980

Related U.S. Application Data

[60] Division of Ser. No. 771,309, Feb. 23, 1977, which is a continuation of Ser. No. 480,280, Jun. 17, 1974, abandoned.

[30] Foreign Application Priority Data

| | | | |
|---|---|---|---|
| Jun. 19, 1973 | [JP] | Japan | 48-69343 |
| Aug. 1, 1973 | [JP] | Japan | 48-87068 |
| Aug. 1, 1973 | [JP] | Japan | 48-87069 |
| Aug. 1, 1973 | [JP] | Japan | 48-87070 |
| Nov. 2, 1973 | [JP] | Japan | 48-123670 |
| Jan. 29, 1974 | [JP] | Japan | 49-12412 |

[51] Int. Cl.[3] ..... G03G 5/04

[52] U.S. Cl. ..... 430/68

[58] Field of Search ..... 430/68, 53; 355/39 C

[56] References Cited

U.S. PATENT DOCUMENTS

| | | | |
|---|---|---|---|
| 3,438,706 | 4/1969 | Tanaka et al. . | |
| 3,645,614 | 2/1972 | McFarlane, Jr. et al. . | |
| 3,666,363 | 5/1972 | Tanaka et al. . | |
| 3,676,117 | 7/1972 | Kinoshita . | |
| 3,677,751 | 7/1972 | Ohta et al. . | |
| 3,680,954 | 8/1972 | Frank . | |
| 3,694,200 | 9/1972 | Pressman . | |
| 3,713,734 | 1/1973 | Crane et al. . | |
| 3,773,417 | 11/1973 | Pressman et al. . | |
| 3,797,926 | 3/1974 | Fotland et al. . | |
| 3,824,010 | 7/1974 | Pressman . | |
| 3,881,921 | 5/1975 | Frank . | |
| 3,936,177 | 2/1976 | Moriyama et al. | 430/53 |
| 3,942,980 | 3/1976 | Hou . | |
| 3,976,484 | 8/1976 | Ando et al. . | |
| 3,986,871 | 10/1976 | Blades et al. | 430/68 |

FOREIGN PATENT DOCUMENTS

| | | |
|---|---|---|
| 48-13063 | 4/1973 | Japan . |

*Primary Examiner*—Richard L. Schilling
*Assistant Examiner*—John L. Goodrow
*Attorney, Agent, or Firm*—Fitzpatrick, Cella, Harper & Scinto

[57] ABSTRACT

An electrophotographic process of this invention is achieved by subjecting a photosensitive screen to a matched performance of voltage applications and image irradiation to form a primary electrostatic latent image for modulating the flow of corona ions to enable a secondary electrostatic latent image on a recording member disposed in close proximity to the screen bearing the primary electrostatic latent image. The screen is made of a conductive member as the basic element for the screen, a photoconductive member covering the substantial part of the conductive member, and a surface insulating member also covering the substantial part of the conductive member and the photoconductive member, in which the conductive member is partly exposed at one surface side of the screen, or it is entirely covered by the surface insulating member with another conductive member to be exposed being provided on said insulating member, and the coating thicknesses of the photoconductive and surface insulating members are thicker at the portion opposite to the surface part of the conductive member to be exposed.

9 Claims, 75 Drawing Figures

FIG. 69
| | POLARITY OF PRIMARY VOLTAGE APPLIED | POLARITY OF SECONDARY VOLTAGE APPLIED | POLARITY OF TERTIARY VOLTAGE APPLIED |
|---|---|---|---|
| 1 | (+) | (−) | (−) |
| 2 | (+) | (−) | AC |
| 3 | (+) | AC | (−) |
| 4 | (+) | AC | AC |
| 5 | (+) | (−) | (+) |
| 6 | (+) | AC | (+) |
FIG. 70
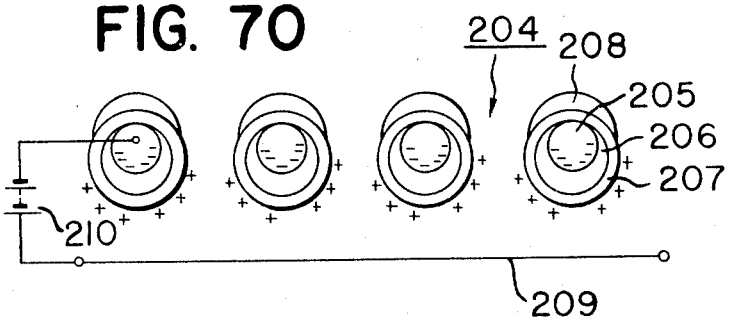
FIG. 71
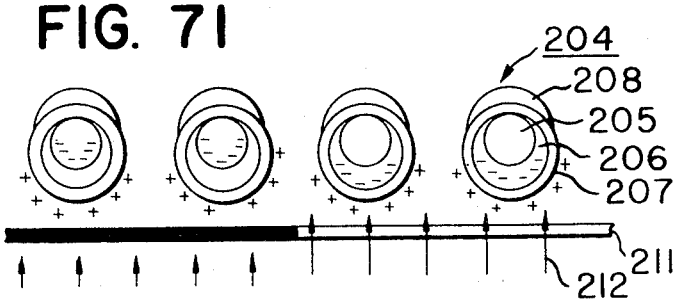

ELECTROPHOTOGRAPHIC SCREEN

This is a division of application Ser. No. 771,309, filed Feb. 23, 1977, which is a continuation of U.S. Ser. No. 480,280 filed June 17, 1974, now abandoned.

BACKGROUND OF THE INVENTION a. Field of the Invention

This invention relates to an electrophotographic process, and, more particularly, it is concerned with the electrophotographic process for forming an image by use of a photosensitive plate having a plurality of openings.

b. Discussion of Prior Arts

As the typical conventional electrophotography, there have been proposed a direct process such as, for example, electrofax, and an indirect process such as xerography. In the direct electrophotographic process, use is made of a specially treated image recording member coated with a photoconductive material such as zinc oxide. This direct method, however, has a drawback in that as the image formed on the recording member lacks brightness, contrasts in the tones of the reproduced image are poor. Moreover, owing to a particular treatment rendered on the recording member, it is heavier than the conventional paper, hence a particular feeding means which is different from that for ordinary paper should be employed. According to the indirect process, an image of high contrast and good quality can be obtained by using ordinary paper as the image recording member. However, in this indirect process, when a toner image is transferred to the recording member, the latter inevitably contacts the surface of the photosensitive member, and, further, cleaning means vigorously touches the surface of the photosensitive member for removal of the residual toner thereon with the consequence that the photosensitive member is impaired every time the transfer and cleaning operations are carried out. As the result of this, life of the expensive photosensitive member becomes shortened, which unavoidably ensues a high cost in the image reproduction.

In order therefore to remove such drawbacks inherent in the conventional electrophotographic processes, there have been contemplated various methods such as, for example, those taught in the U.S. Pat. Nos. 3,220,324, 3,645,614, 3,647,291, 3,680,954, and 3,713,734. In these patents, there is used a photosensitive member the screen type or grid type having a number of openings in the form of fine net. The electrostatic latent image is formed on the recording member by modulating flow path of ions through the screen or grid, after which the latent image formed on the recording material is visualized. In this case, the screen or grid which corresponds to the photosensitive member need be neither developed nor cleaned, hence the life of the screen or grid can be prolonged.

U.S. Pat. No. 3,220,324 teaches use of a conductive screen coated with a photoconductive material, through which an image exposure is effected onto the recording member simultaneously with the corona discharge. The flow of corona ions produced as the consequence of the corona discharge is modulated by the screen, whereby an electrostatic latent image is formed on the recording member. In this process, wherein the screen charging and the image exposure are simultaneously effected, it is difficult to charge the photoconductive material coated on the conductive screen at a sufficiently high potential. Accordingly, the efficiency in the image exposure becomes lowered to make it difficult to obtain the image reproduction at a high quality. Further, at the dark image portion where the corona ions pass, if the potential to the conductive screen is raised too high, the applied corona ions are repulsed with the consequence that they are directed to the bright image portion in the vicinity of the dark image portion of the exposed conductive screen, hence no satisfactory image reproduction can be expected.

U.S. Pat. No. 3,680,954 teaches use of a conductive grid coated with a photoconductive material, and a conductive control grid, in which an electrostatic latent image is formed on the conductive grid, and different electric fields are formed on both conductive grid and control grid so as to modulate flow of the corona ions for forming an image on the recording member. In this patented process, however, it is quite difficult to hold the control grid and the conductive grid to form an electrostatic latent image over a large area with fine space intervals therebetween. Moreover, the control grid absorbs the corona ions to be imparted to the recording member with the result that the image recording efficiency becomes lowered. In the case of forming a positive image, the flow of the corona ions having a polarity opposite to that of the latent image is applied, and almost the entire part of the ion flow directs to the latent image to negate the latent image, so that the desired positive image is difficult to be reproduced.

In U.S. Pat. No. 3,645,614, the screen comprises an insulating material overlaid with a conductive material, and the insulating material comprises a photoconductive material. An electric field to prevent the ion flow from passing through the screen is formed at the openings or perforations for permitting the ion flow to pass therethrough owing to the electrostatic latent image formed on the screen. This process has a drawback in that an image to be formed on the recording member is the image reversal of the latent image on the screen.

U.S. Pat. No. 3,713,734 teaches use of a four-layer screen consisting of a photoconductive substance, a first conductive substance, an insulating substance, and a second conductive substance, in which an electrostatic latent image is formed on the photoconductive substance in conformity to the original picture image by the processes of electric charging and image exposure. Also, in the case of forming an image on the recording member by modulating the flow of the corona ions through the electrostatic latent image, the second conductive substance of the screen is imparted by a voltage having a polarity opposite to that of the electrostatic latent image on the screen, since the image is in a single polarity. By this application of the electric field, there are formed two regions, i.e., a region to permit the ion flow to pass through the screen in accordance with the latent image on the screen, and another region to inhibit the passage of the ion flow, whereby a desired electrostatic latent image is formed on the recording member. According to this patented process, it is possible to reproduce a favorable positive image, although the process has two major disadvantages such that two layers of the conductive substance must be provided on the thinly formed screen, which entails complexity in the manufacture of such screen, and that instability remains between the facing layers of the conductive substance owing to electric discharge. Further, the electric charge on the photoconductive substance layer is liable to attenuate, and the configuration of the layer tends to largely fluctuate in the course of its manufacturing, on account of which it becomes difficult to obtain a persistent electrostatic latent image on the photoconductive substance layer over a long period of time, and to modulate the ion flow for many repeated times by the electrostatic latent image on the one and same screen.

U.S. Pat. No. 3,647,291 teaches the formation of electrostatic latent images having mutually different polarities on a two-layer screen consisting of a conductive substance and a photoconductive substance in correspondence to a bright image portion and a dark image portion so as to modulate passage of the corona ion flow by the latent image formed on the screen. However, with this patented method, as described in its specification, it is very difficult to form a latent image of both polarities on the photoconductive insulating substance in laminar form. Rather, in the case of forming the electrostatic latent image on this laminar insulating substance, it is necessary to transfer the latent image once formed on a separate photosensitive body. That is, according to the patented method as outlined above, there takes place an electric charge loss in the course of the image forming process, and the construction of the electrophotographing device becomes inevitably complicated. In particular, in case the electrostatic latent image is to be transferred onto the screen from the photosensitive body, the latent image tends to flow toward the conductive substance which has been exposed at the side of the screen openings, on account of which the desired electrostatic latent image can hardly be obtained on the screen with satisfactory contrast in the tones of the image.

SUMMARY OF THE INVENTION

In view of the foregoing discussion of various prior art known to the applicants, it is a primary object of the present invention to provide an improved electrophotographic reproduction process free from all disadvantages and defects inherent in the known prior art.

It is a secondary object of the present invention to provide an improved electrophotographic process which enables a reproduced image to be formed on various kinds of recording members.

It is a tertiary object of the present invention to provide an improved electrophotographic process which has successfully solved the afore-described defects in the conventional electrophotographic processes, and enables information of both positive and negative images on the recording member in exact conformity to the original image.

It is a quaternary object of the present invention to provide an improved electrophotographic process, by which a complete, reproduced image of sufficient contrast in the tones of image and free from fog is obtained.

It is a quinary object of the present invention to provide an improved electrophotographic process which enables the ion flow to be modulated over many repeated times from the one and same electrostatic image formed on the screen.

The foregoing major objects and other objects, as well as construction and function of the present invention will become more readily understandable from the following detailed description thereof with its resulting effects, when read in conjunction with the accompanying drawings.

BRIEF DESCRIPTION OF THE DRAWINGS

FIG. 69 is a table showing the polarity of voltage for use at the time of applying the primary, secondary, tertiary voltages in the electrophotographic processes according to the present invention;

FIGS. 70 to 73 inclusive are respectively schematic diagrams to explain the forming processes of the primary electrostatic latent image on the screen;

DETAILED DESCRIPTION OF THE INVENTION

At the outset, the electrophotographic reproduction process according to the present invention will be outlined in the following.

The photosensitive screen to be used for the electrophotographic reproduction process is provided therein with a multitude of small openings. Its basic construction is composed of a conductive member as the base, on which a photoconductive member and a surface insulating member are laminated. One surface part of this screen is rendered electrically conductive partially or in its entirety. A primary electrostatic latent image is formed on the screen by carrying out in combination a voltage application step such as electric charging, removal of such charge, etc., an irradiation step such as irradiation of an original image, and an overall irradiation of the latent image surface to be performed as the case may be. Subsequently, a secondary electrostatic latent image is formed by the same screen by applying modulated corona ions onto an electrically chargeable member such as recording member, and so on. The modulated corona ions is obtained by first impressing a flow of corona ions from a generating source of such ions onto the abovementioned screen, and then modulating the ion flow passing through the screen by the primary electrostatic latent image formed thereon.

For the purpose of the present invention, the term "primary electrostatic latent image" is meant by an electrostatic latent image formed on the photosensitive screen in conformity to the original image through the process steps as described above, and the term "secondary electrostatic latent image" is meant by one formed on the electrically chargeable member by the flow of corona ions which has been modulated with the abovementioned primary electrostatic latent image on the screen in the course of its passage therethrough.

The above-outlined invention will be described in more detail hereinbelow with reference to preferred embodiments and explanatory diagrams therefor as illustrated in the accompanying drawing.

The first embodiment of the present invention is the electrophotographic process comprising application of a primary voltage to electrically charge the entire surface of the screen in a uniform manner so as to form a primary electrostatic latent image thereon; irradiation of an original image to take place subsequently; and application of a secondary voltage to vary the surface potential of the screen already subjected to the primary voltage impression.

Figure 1:
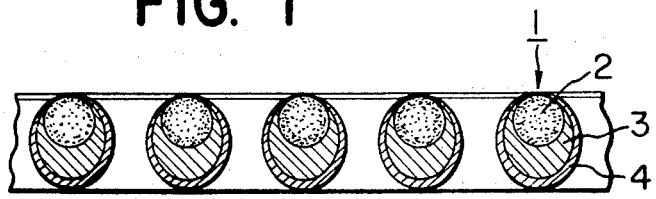
FIG. 1 is an enlarged cross-sectional view of a photosensitive screen for use in the electrophotographic reproduction process according to the present invention.

The photosensitive screen to be used for this electrophotographic process is basically composed, as already mentioned in the foregoing, of a conductive member as the base, on which a photoconductive member and a surface insulating member are provided. One embodiment of such photosensitive screen is shown in FIG. 1 in an enlarged cross-section. As seen from FIG. 1, the screen 1 has a multitude of openings, in each of which a conductive member 2 is placed in a manner to be partially exposed outside, and, surrounding the conductive member 1, a photoconductive member 3 and a surface insulating member 4 are provided in sequence.

For the conductive member 2 to constitute the screen 1, a flat plate of a substance of high electric conductivity such as nickel, stainless steel, copper, aluminum, tin, etc. is etched to form a great many small openings (in this case, its cross-section mostly assumes rectangular shape), or a net is produced by electroplating or with their wires of the abovementioned metallic substance (in this case, the cross-section of the opening mostly assumes roundish shape). The conductive member 2, for the purpose of reproduction in general offices, may be appropriate to have from 100 to 300 meshes in the screen 1 from the standpoint of the required resolution. Also, when the conductive member is to be produced from the flat plate as mentioned above, the optimum thickness of the plate may be determined from the mesh size and shape of the small openings. On the other hand, when the conductive member 2 is manufactured from their metal wires, the optimum diameter of the wires may be determined in correspondence to the mesh size of the screen to be obtained.

The photoconductive member 3 is formed on the conductive member 2 by vacuum evaporation of an alloy or an intermetallic compound containing S, Se, PbO, and S, Se, Te, As, Sb, Pb, etc.. Also, according to the sputtering method, a high melting point photoconductive substance such as ZnO, CdS, $TiO_2$, etc. can be adhered onto the conductive member 2. By the spraying method, it is possible to use organic semiconductors such as polyvinyl carbazole (PVCz), anthracene, phthalocyanine, etc., and those semiconductors with increased sensitivity for coloring substances and Louis acid, and a mixture of these semiconductors and an insulative binder. For this spray method, a mixture of ZnO, CdS, $TiO_2$, PbO, and other inorganic photoconductive particles and an insulative binder can also be used suitably.

For the insulative binder to be used for preparing the mixture of the inorganic photoconductive substances and organic semiconductors, any organic insulative substance and inorganic insulative substance for use as the surface insulating member to be described hereinafter may be properly used.

Thickness of the photoconductive member 3 to be deposited on the conductive member 2 by any of the abovementioned expedients may appropriately range from 10 to 80 microns at the maximum, although it depends on the class and characteristics of such photoconductive substance to be used.

The surface insulating member 4 should essentially be highly resistive, electric charge sustainable, and transparent to permit irradiated light to pass therethrough. The member is not always required to have high resistance against wear and tear. Materials that satisfy the abovementioned requirements are polyethylene, polypropylene, polystyrene, polyvinyl chloride, polyvinyl acetate, acrylic resin, polycarbonate, silicon resin, fluorine resin, epoxy resin, and other organic insulative substances; copolymers or mixtures of these monomeric substances in solvent type, thermal polymerization type, photopolymerization type, etc.. These materials can be formed on the photoconductive member 3 by the spray method or the vacuum evaporation. A vacuum evaporated layer of organic polymer substances obtained by the vapor-phase polymerization such as parylene (a generic name for thermoplastic film polymers based on para-xylylene), and inorganic insulative substances are also effective for the purpose. The thickness of the surface insulating member to be formed on the photoconductive member 3 by the abovementioned method may be appropriately determined in relation to the thickness of the photoconductive member 3.

Since the photosensitive screen according to the present invention should essentially have one surface part thereof rendered electrically conductive, the screen is required to be conducted in such a manner that the conductive member 2 be exposed to one surface part of the screen 1. On account of this, when the photoconductive member 3 and the surface insulating member 4 are formed on the conductive member 2, as in the above-described screen construction, each of these substances had better be adhered from one side of the conductive member 2, i.e., a side opposite to the side to be exposed. It may also be possible to spray or vapor-evaporate these substances from a slant direction so as to secure good adhesion of these photoconductive and surface insulating substances onto the side surface of the openings. Should it happen that these photoconductive and surface insulating substances unavoidably come around to the one surface part of the conductive member to be exposed, these substances are removed by various expedients such as an abrasive agent, whereby the necessary part of the conductive member 2 becomes again exposed.

In the present invention, the primary electrostatic latent image is formed on the surface insulating member 4 which covers the substantially entire surface of the photosensitive screen 1, the effect of which will be as follows. That is to say, by forming the primary electrostatic latent image on the insulative member 4, attenuation of the latent image becomes remarkably low in comparison with that of a latent image formed on the photoconductive member which is in an insulated state. The reason for this may be that the pure insulating member has a higher electric resistance than the photoconductive member which is in the insulated state by the insulating member, on account of which the screen 1 is capable of storing high electric charge quantity, hence the primary electrostatic latent image can be formed at high electrostatic contrast. Further, since the primary electrostatic latent image formed on the insulating member 4 has very low attenuation, it becomes possible to modulate the ion-flow over many repeated times by the same primary electrostatic latent image, whereby the so-called retention copying, which obtains a multitude of the reproduced image from the one and same primary electrostatic latent image, becomes feasible.

The process steps for forming the primary and secondary electrostatic latent image by the electrophotographic process according to the present invention using the abovementioned photosensitive screen 1 will now be described with reference to FIGS. 2 to 5 which show, respectively, the primary voltage application onto the screen, the image irradiation and the secondary voltage application, the irradiation of the overall surface of the screen, and the secondary electrostatic latent image formation to be carried out by modulation of the ion-flow through the primary electrostatic latent image formed on the screen by the preceding process steps. The explanations hereinbelow of the electrophotography will be made on the assumption that the photoconductive substances such as selenium and its alloys with the hole as the principal carrier therefor are used. In addition, the conventional type of the electric voltage applying means such as the corona discharger, the roller discharger, and so forth are applicable for the purpose of the voltage impression. Of these known expedients, the corona discharger is particularly preferable, hence the explanations which follow will be made in reference to the corona discharger.

Figure 2:
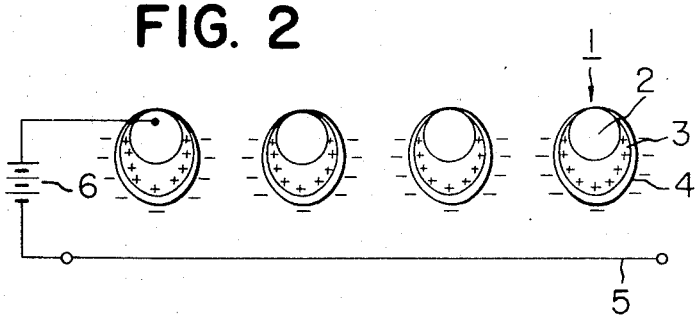
FIGS. 2 to 4 are respectively schematic diagrams to explain the forming processes of a primary electrostatic latent image on the photosensitive screen shown in FIG. 1.

In the electric voltage application step as shown in FIG. 2, the screen 1 is uniformly charged with the negative polarity by the corona discharger as the voltage application means which takes electric power from a power source 6 through a corona wire 5 of the discharger. By this electric charge, a negative charge is accumulated on the surface of the insulating member 4, while a charge having a polarity opposite to that on the insulating member 4, i.e., a positive charge in this case, is accumulated at the photoconductive member 3 in the vicinity of the insulating member 4. Where the interface between the conductive member 2 and the photoconductive member 3 per se are of such nature that permit injection of the majority carrier, but does not permit injection of the minority carrier, and that has the rectifiability as the screen, the layer of electric charge can be formed in the photoconductive member 3 at a place adjacent to the insulating member 4. With the screen not having such rectifiability, or not forming the electric charge layer as mentioned above, the primary voltage can be impressed thereon by the charging method of the insulating member as taught in U.S. Pat. No. 2,955,938.

In the primary voltage application step as described above, it is preferable that the electric voltage be applied to the screen from the surface thereof where the insulating member 4 exists (this surface will hereinafter be called "surface A"). On the contrary, satisfactory charging is difficult to be realized on the insulating member 4 even when the corona discharge, etc. is impressed on the surface when the conductive member 2 is present (this surface will hereinafter be called "surface B"), because the corona ions flow into the conductive member 2.

Figure 3:
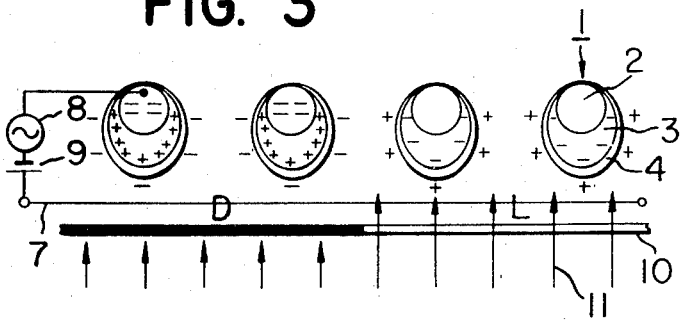

FIG. 3 indicates a result of the simultaneous image irradiation and secondary voltage impression onto the screen 1 which has undergone the abovementioned first voltage impression. For the sake of proper understanding of this figure, the reference numeral 7 designates a corona wire for the corona discharger, the numeral 8 designates a power source for the corona wire 7, the numeral 9 is a power source for bias voltage, the numeral 10 is an original image, of which the reference letter D indicates a dark image portion and the letter L indicates a bright image portion, and the arrows 11 designate light from a light source (not shown).

In the embodiment shown in FIG. 3, electric discharge is carried out by the corona discharge through the corona wire 7, on which an alternating current voltage superposed by a direct current voltage of the positive polarity in such a manner that the surface potential of the abovementioned insulating member 4 may become the substantially positive polarity. When the A.C. corona discharge is used, the surface potential of the insulating member 4 must be substantially zero due to alternate discharge of positive and negative polarities. However, in the actual phenomenon to take place, the negative corona discharge generated thereby is stronger than the positive corona discharge with the consequent difficulty to render the surface potential of the insulating member 4 to be in the positive polarity as mentioned above. For this reason, various measures are taken to make it easier to render the surface potential positive such as, for example, superposing a positive bias voltage on the A.C. voltage, or reducing the negative current in the A.C. power source. It goes without saying that, for the purpose of the secondary voltage application, a D.C. corona discharge of a polarity opposite to that of the primary voltage application can be used besides use of the A.C. voltage so as to render the surface potential of the insulating member 4 to be in an opposite polarity to that of the primary voltage application.

As described in the foregoing, when the surface potential of the insulating member 4 is rendered positive, the substance constituting the photoconductive member 3 becomes conductive at the bright image portion L due to the image irradiation, in consequence of which the surface potential of the insulating member 4 becomes positive. On the other hand, however, the surface potential of the insulating member 4 at the dark image portion D remains negative on account of the positive charge layer present in the photoconductive member 3 to the side of the insulating member 4.

The relationship between the image irradiation step and the secondary voltage application step as in the above-exemplified transmission system is such that, when the substance constituting the photoconductive member 3 has a persistent photoconductivity, the two steps are not carried out simultaneously, contrary to the foregoing explanation, but may be done sequentially. Further, the direction for the image irradiation may preferably be from the surface A of the screen 1, although it can also be done from the surface B. In the latter case, however, the resolution and the sensitivity of the reproduced image may be inferior to those of the former case. For the purpose of the image irradiation, a light source is generally used. Besides the light source, radioactive rays, etc. which indicates response to the substance of the photoconductive member 3 may be used.

Considering now the changing speed of the polarity of the potential on the insulating member 4 of the screen in the above-described steps, it is observed that the portion of the insulating member 4 facing the corona wire 7 exhibits the quickest change in the polarity, and the side surface portion and its vicinity sandwiching the abovementioned portion facing the corona wire 7 changes its polarity a bit later than the sandwiched portion. Accordingly, in the image irradiating portion, the electric potential at the surface B of the screen 1 corresponds to that of the conductive member 2, and the potential assumes a state of gradual increase as it shifts from the surface B to the surface A.

Figure 4:
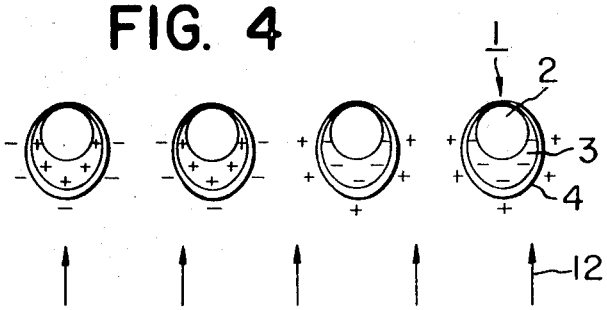

FIG. 4 indicates a result of conducting uniform exposure over the entire surface of the screen 1 which has been subjected to the image irradiation step and the secondary voltage application step. In the drawing, the arrows 12 indicate light from a light source. By this overall irradiation step, the electric potential of the dark image portion D on the screen 1 changes in proportion to the electric charge quantity on the surface of the insulating member 4. As the result of this potential change, the following relationship is established between the contrast $V_c$ of the resultant electrostatic latent image and the electric charge potential $V_a$ obtained by the primary voltage application step:

$$V_c = \frac{C_i}{C_i + C_p} V_a \tag{1}$$

where $C_i$ is an electrostatic capacitance of the insulating member 4, and $C_p$ is an electrostatic capacitance of the photoconductive member 3.

When a photosensitive body of a three-layer structure consisting of a conductive base plate, a photoconductive layer, and a surface insulating layer is used, it is desirable that the electrostatic capacitance ratio between $C_i$ (insulating layer) and $C_p$ (photoconductive layer) be 1 to 1 or so. However, in the case of the electrophotographic process using the photosensitive screen, particularly in the retention copying as is the case with the present invention, an effective result can be obtained if the electrostatic capacitance ratio between $C_i$ and $C_p$ is set at 2 to 1 or so. Also, coating thickness of the photoconductive member 3 surrounding the conductive member 2 becomes consecutively thinner from the surface A toward the surface B. On account of this, as the charge layer in the photoconductive member 3 is extinguished by the overall irradiation at the dark image portion, the electric potential in the screen gradually changes to a higher negative potential from the surface B toward the surface A of the screen 1. Incidentally, the above-described overall irradiation step is not always necessary. However, by conducting this process step, it becomes possible to quickly form the primary electrostatic latent image on the screen 1 where the electrostatic contrast should be kept high.

Figure 5:
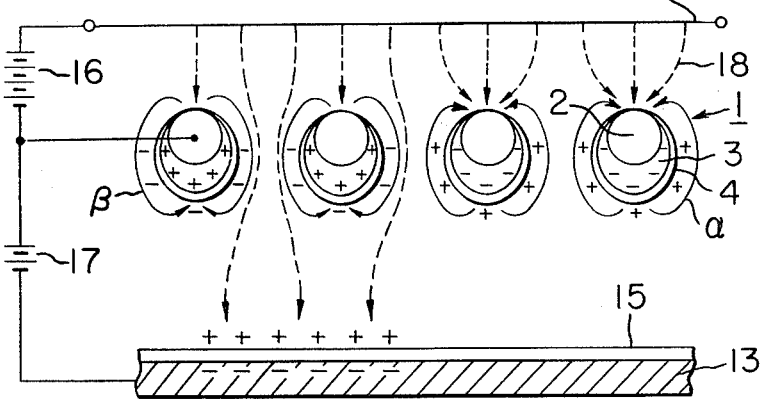
FIGS. 5 and 6 are respectively schematic diagrams to explain the forming processes of a secondary electrostatic latent image by the same screen as shown in FIG. 1.

FIG. 5 indicates the secondary electrostatic latent image forming process, wherein a positive electrostatic latent image is conformity to the original image is formed on the recording member by the primary electrostatic latent image on the abovementioned screen 1. In the drawing, the reference numeral 13 designates a conductive support member which also serves as an opposite electrode of the corona wire 14 of the corona discharger, and the reference numeral 15 designates the recording member such as electrostatic recording paper, etc. which is disposed in such a manner that its chargeable surface is faced toward the screen 1, while its conductive surface is made to contact the conductive support member 13. The chargeable surface of the recording member 15 is disposed facing toward the surface A of the screen 1 at an appropriate space interval therebetween of from 1 mm to 10 mm or so.

When the secondary electrostatic latent image is to be formed on the abovementioned recording member 15, the flow of the corona ions is directed to the recording member 15 from the corona wire 14. At this time, the bright image portion of the screen 1 is constantly changing its potential difference from the surface A to the surface B, thereby creating an electric field as indicated by solid lines $\alpha$ in FIG. 5, whereby the passage of the corona ions through the openings of the screen 1 is inhibited to result in flowing of the corona ions into the partly exposed conductive member 2. If it is assumed that the surface B of the screen 1 is entirely covered with the insulating member 3, the screen is charged in the polarity of the corona ions from the corona wire 14, and the passage of the corona ions through the opening part of the screen is accelerated by the charged potential. In other words, as the corona ions pass through even the bright image portion, there is caused fog in the secondary electrostatic latent image formed on the recording member 15. In contrast to this, the electric potential is continuously changing smoothly at the dark image portion of the screen 1 from the surface B to the surface A, whereby an electric field as shown by solid lines $\beta$ is created, and the corona ions, in spite of their being in an opposite polarity from that of the electrostatic latent image on the insulating member 4, reach the recording member 15 in an effective manner in a state of causing the latent image to be extinguished to a lesser degree. Inversely, when the original image is to be formed on the recording member by way of a positive electrostatic latent image, an electric voltage having the same polarity as that of the electric charge on the insulating member 4 to the dark image portion of the screen 1. The reference numeral 16 in FIG. 5 designates a power source for the corona wire 14, and the numeral 17 designates another power source to the conductive supporting member 13. In such construction, the electric voltage may be impressed on the screen 1 in such a manner that an electric potential difference may occur in the direction of from the corona wire 14 to the conductive supporting member 13 by way of the screen 1.

On the other hand, the voltage impression to the corona wire can be done not only by the D.C. voltage as mentioned above, but also by the A.C. voltage. In this case, wherein the primary electrostatic latent image on the screen 1 is in the abovementioned state, of a voltage of the negative polarity is impressed onto the side of the conductive supporting member 13, a positive electrostatic latent image can be obtained, and, if a voltage of the positive polarity is impressed, a negative elctrostatic latent image can be obtained. The dotted lines 18 in the drawing designate the flow of the corona ions from the corona wire 14.

For the recording member 15, not only those having the two-layer structure consisting of the chargeable layer and the conductive layer such as the electrostatic recording paper, but also any insulating member such as polyethylene terephthalate are usable. In using such insulating member as mentioned above, however, the insulating member must be sufficiently closely adhered onto the conductive supporting member 13, otherwise, there occurs irregularities in the secondary electrostatic latent image formed on the recording member. As the means of removing such defect as mentioned above, application of the voltage to the recording member 15 by the corona discharge in place of using the conductive supporting member 13 is effective.

The reason for such favorable result when the screen 1 of the afore-described construction is used, in particular, for the retention copying is considered due to the fact that the primary electrostatic latent image having a smooth potential change is formed on the insulating member 4 at the opening part of the screen 1. Furthermore, such effect is presumed to derive from the function such that the surplus flow of the corona ions from the corona wire is absorbed by the conductive member exposed to the side of the surface B of the abovementioned screen 1.

Moreover, in carrying out the retention copying, there takes place sometimes a situation, in which the flowing quantity of the corona ions passing through the screen 1 is rather small at the time of forming the secondary electrostatic latent image on the recording member 15; particularly, at the time of modulating the ion flow at the initial stage. If the latent image formed on the recording member under such electric conditions is developed, a reproduction image having varying density is resulted. The cause for such undesirable phenomenon is considered due to the fact that a part of the corona ions flows toward the part in the vicinity of the surface B from the opening part of the screen 1. Upon undergoing the above-described phenomenon, the corona ions which flows toward the above-described part quenches to attain an equilibrated condition. In case the above-described phenomenon tends to occur, such phenomenon can be prevented from generation by the following method. The first method is to increase the corona discharge current for the secondary electrostatic latent image formation by 10 to 100% or so to the ordinary level with respect to the first sheet or several sheets of the retention copy in accordance with increase in the voltage to be impressed on the corona wire 14, or change in the position of the corona wire 14, and so forth. The second method is to apply to the screen 1 from its surface B a separate corona discharge having the same polarity as that of the corona discharge for the secondary electrostatic image formation, the corona discharge of which is different from that for the secondary electrostatic latent image formation. The electric current for this corona discharge may be sufficient to be from a few fractions to a several time of ordinary current amount. In the second method, however, presence of the conductive supporting member 13 which functions as the opposite electrode to the corona wire 14 is desirable for the following reason. If there is no opposite electrode, on which electric voltage is impressed, it may happen that even the principal part of the primary electrostatic latent image becomes quenched.

Figure 6:
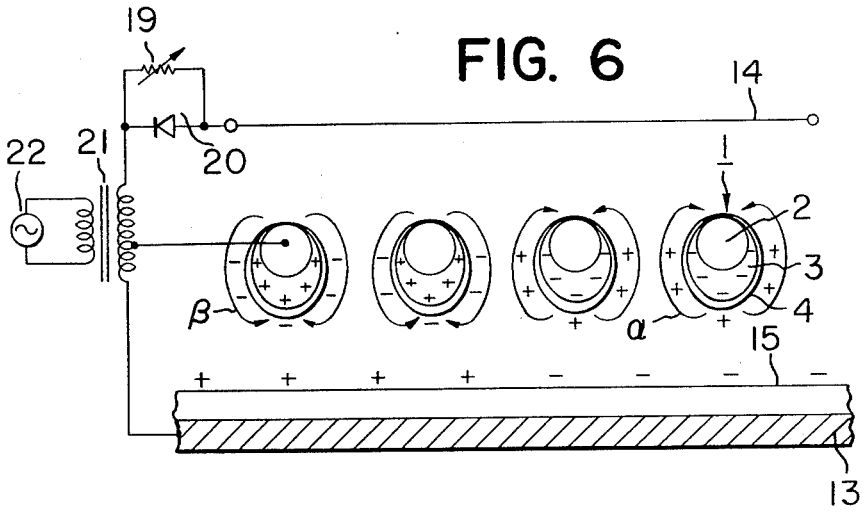

On the other hand, when the corona discharge by the D.C. voltage application is used for forming the secondary electrostatic latent image as mentioned above, the secondary electrostatic image formed on the recording member, etc. becomes the electrostatic latent image of a single polarity, either positive or negative. On account of this, there may take place a fogging phenomenon, etc. with the developed image depending on the electric potential of the electrostatic latent image, hence good reproduction image cannot be obtained. However, the contrast in the secondary electrostatic latent image in its development is possibly heightened by the following method, in which the polarity of the voltage to be impressed on the discharge electrode for the flow of the corona ions that is applied onto the recording member, etc. through the screen 1 for the secondary electrostatic latent image formation, and the polarity of the voltage to be impressed on the opposite electrode such as the abovementioned conductive supporting member, etc. which faces the corona discharge electrode are of mutually different polarity, i.e., positive (+) and negative (−), or vice versa. Examples of the abovementioned alternate polarity are such one that an alternating current (A.C.) voltage is mutually shifted by 180 degrees in phase, or one or more pairs of direct current corona discharge having the positive and negative polarities are used. One example of such method will be described with particularities as follows with reference to FIG. 6, in which the same parts are designated by the same reference numerals as used in FIG. 5. In the drawing, the reference numeral 19 designates a variable resistor, the numeral 20 designates a rectifier, the numeral 21 a transformer, and the numeral 22 refers to an A.C. power source. The construction of the screen and the electrostatic latent image forming process for the ion modulation are not limited to those mentioned above, but it is only sufficient if the primary electrostatic latent image on the screen 1 is almost symmetrical from the standpoint of the electric charging in the bright and dark image portions of the original image. The recording member, too, is not limited to the recording paper, but any chargeable member may suffice the requirement. Moreover, as in the basic device shown in FIG. 6, an output having a constantly legged phase by 180 degrees can be obtained by using an A.C. power source 22, and a transformer 21 having intermediate terminals, the one being connected to the corona wire 14 of the corona discharger by way of the variable resistor 19 and the rectifier 20, and the other being connected to the conductive supporting member 13. In this circuit construction, the variable resistor 19 and the rectifier 20 function to adjust intensity of the polarity (positive and negative) of the A.C. voltage as well as to control the conditions of the seconary electrostatic latent image on the recording member 15. An interval between the screen 1 and the recording member 15 is appropriately from 1 to 10 mm, and the electric voltage to be applied to the screen 1 is preferably 0.5 to 5 KV or so at the peak value. It is of course possible that other electric components than the abovementioned variable resistor 19 and rectifier 20 are used to obtain an output constantly lagged by 180° in phase as mentioned above using the alternate current power source 22. It is also possible that the A.C. corona discharge is impressed on the recording member 15 by the corona discharger from a side opposite to the screen 1 without using the conductive support member 13. In any case, when the corona ions to be modulated are of the alternating current, it is desirable that an electric voltage of a mutually opposite polarity be impressed between the corona wire 14 and the conductive supporting member 13 over the substantially entire period of the ion flow modulating step. For this reason, the use of the transformer 21 is nothing but an example of the ion flow modulating method. This transformer can be replaced by various methods such as, for example, controlling two direct current power sources having mutually opposite polarity by means of a relay, and so forth. By using such method, the conductive support member 13 is maintained in the negative polarity, as far as the corona wire 14 is maintained in the positive polarity, whereby the positive ions pass through only the portion where the screen 1 is maintained in the negative polarity, and adhere onto the recording member 15. On the other hand, while the corona wire 14 is in the negative polarity, the conductive support member 13 is kept in the positive polarity, whereby the negative ions pass through only the portion where the screen 1 is maintained in the positive polarity and adhere onto the recording member 15. As the result of such processing, there is formed a secondary electrostatic latent image on the recording member, wherein the dark image portion is in the negative polarity and the bright image portion is in the positive polarity. When this secondary electrostatic latent image is developed by use of coloring particles such as toner having the positive polarity, a reproduction of the original image free from the fogging can be easily obtained. Also, harmony in this reproduced image can be adjusted appropriately by the variable resistor 19. Needless to say, production of a negative image is also possible when a toner of the negative polarity is used.

DESCRIPTION OF THE PREFERRED EMBODIMENTS

In order to enable persons skilled in the art to reduce the present invention as described in the foregoing to practice, the following preferred embodiments of the electrophotographic method are presented. It should however be noted that changes and modifications may be made to the extent that they do not depart from the spirit and scope of the present invention as recited in the appended claims.

First Embodiment

In the production of the photosenstive screen for use in the electrophotographic method according to the present invention, selenium (Se) is deposited by the vacuum-evaporation onto a conductive member of 200 mesh made of a stainless steel wire of 40 microns in diameter in such a manner that the openings of the conductive member may not be closed by the evaporated metal. At this time, the deposition of the vacuum evaporated selenium is conducted so as to bring thickness of the deposited layer on the conductive member at the thickest portion thereof to approximately 50 microns.

Subsequently, parylene as the insulative substance is adhered onto the thus obtained selenium photoconductive member to a thickness of about 10 microns. Since parylene is coated on the entire surface of the photoconductive member, the surface opposite to that where selenium as a screen for the conductive member is deposited at its maximum thickness is ground by an abrasive agent so as to expose a part of the conductive member to the external atmosphere. For the surface insulating member, a thinner solution of polystyrene can be spray-coated on the photoconductive member in place of the abovementioned parylene.

The screen produced in the above process steps is then charged to −500 V in the primary voltage application step. Following this electric charging, irradiation of an image to be reproduced is conducted with an exposure light of 30 lux per second, and, at almost same time, corona dishcarge is imparted to an electric current in the negative direction by means of A.C. current through a resistance component of 10 MΩ. After this, when the overall surface of the screen is irradiated, a primary electrostatic image is formed on the surface insulating member of the screen, the surface potential at the bright image portion being +150 V, while that at the dark image portion being −200 V. An electrostatic recording paper is then placed facing the thus formed primary electrostatic latent image at a space interval therebetween of 3 mm, and a positive corona discharge is carried out onto the recording paper through the primary electrostatic latent image formed on the surface insulating member of the screen, while maintaining the potential of the recording paper at −2 KV with respect to the conductive member, whereby the flow of corona ions is modulated by the primary electrostatic latent image, and the secondary electrostatic latent image is formed on the recording paper.

The recording paper bearing the secondary electrostatic latent image formed by the afore-described processes is then subject to development by use of negatively charged color developing particles in liquid developer. As the result, a reproduced image having high resolution and capable of reproducing even intermediate color tones in the original at high fidelity.

When retention copying is done for 50 consecutive times using the one and same primary electrostatic latent image formed on the screen, it is found out that the image density of the reproduced image at the fiftieth slightly lowers, although no inconvenience is felt at all for the practical use thereof. In forming the secondary electrostatic latent image, if it is assumed that the screen is stationary, the corona discharger for the ion flow modulation can be moved at a velocity of 30 cm/sec. and higher, whereby designing of a high speed and compact type reproduction machine becomes possible.

Second Embodiment

In the production of the photosensitive screen for use in the electrophotographic process according to the present invention, a solution of CdS powder used as a photosensitive body in ordinary electrophotography and 20% by weight of solvent type epoxy resin as a binder is spray-coated from one direction onto metal net of 200 mesh made of stainless steel wire of 30 microns in diameter as the conductive member in such a manner that the openings of the conductive member may not be closed, thereby forming the photoconductive member. After drying and polymerizing the coated epoxy resin, the same resin as the abovementioned binder is spray-coated in the same manner as in coating the photoconductive member in a manner not to close the openings of the conductive member, thereby forming the surface insulating member.

In forming the primary electrostatic latent image, the electric voltage to be applied to the corona discharge in the primary voltage application step is made an opposite polarity to the case of the first embodiment, and the corona discharge is conducted.

The image irradiation step is carried out by irradiating the image with an exposure light of 8 lux/second. As the result, there is formed on the screen the primary electrostatic latent image having the surface potential of −100 V at the bright image portion and +200 V at the dark image portion.

In forming the secondary electrostatic latent image, a negative corona discharge is carried out, and the secondary electrostatic latent image formed on the electrostatic recording member is developed by positively charged coloring particles in the dry development method. The reproduced image obtained thereby has high image resolution same as in the foregoing first embodiment, and is capable of reproducing the intermediate color tones of the original image at high fidelity.

Also, in the same manner as in the first embodiment, the retention copying is carried out by use of the photosensitive screen bearing the electrostatic latent image formed by the afore-described process steps. The result is such that good quality of image which is not much different from the initial copy can be reproduced even after copying more than thirty sheets.

FIGS. 7 to 13 inclusive indicate one example of the electrophotographic reproduction machine, in which the afore-described photosensitive screen 1 is applicable.

In the present invention, the corona discharge for forming the primary electrostatic latent image is carried out from the surface A, and the other corona discharge for the image irradiation and the secondary electrostatic latent image formation is carried out from the surface B. Accordingly, when the screen 1 is flat and stationary, the recording member should be caused to pass through a charging device for the latent image formation or a discharging device between the photosensitive screen and a conveying device for positioning the recording member adjacent to the screen 1.

Figure 7:
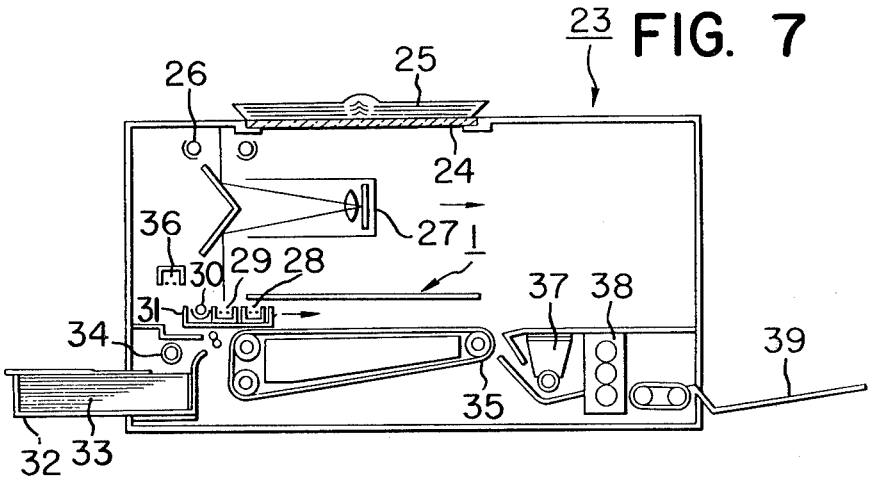
FIGS. 7 to 13 inclusive are respectively schematic side elevational views in longitudinal cross-section showing one embodiment of the electrophotographic reproduction device, in which the photosensitive screen of FIG. 1 is incorporated.
Figure 8:
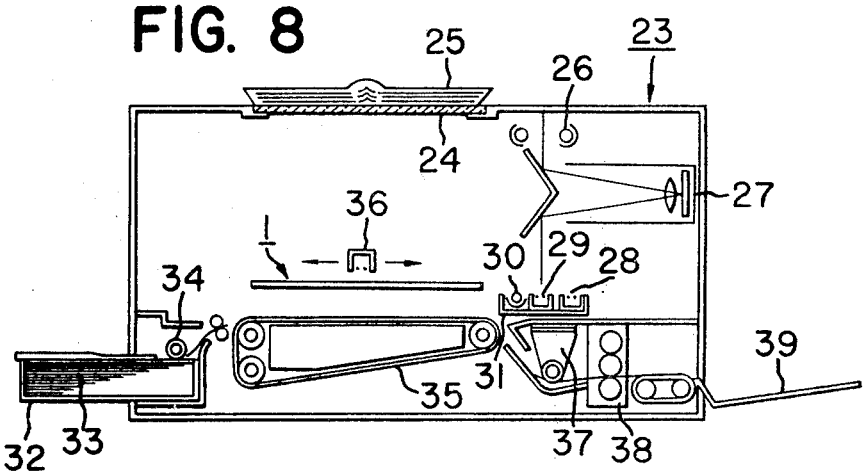

The electrophotographic reproduction device 23 shown in FIG. 7 is constructed by a fixed table 24 for placing an original image to be reproduced 25, a lamp 26 to illuminate the original image 25, a movable optical system 27 consisting of a reflection means and a lens, a corona discharger 28 to carry out the primary voltage application to the flat, stationary type photosensitive screen 1, another corona discharger 29, a lamp 30 for overall surface irradiation, and a container 31 to hold the abovementioned corona dischargers 28 and 29, and the lamp 30, which is shiftable in parallel with the screen 1. The device further comprises a cassette 32 for accommodating electrostatic recording paper 33 in cut sheets, a feeding roller 34 to send out the recording paper 33 sheet by sheet, a conveyor belt 35 provided with a Saxon conveying mechanism and to carry the recording paper beneath the screen 1, a corona discharger 36 to form a secondary electrostatic latent image, a magnetic brush developing means 37, a heating roller type fixing means 38, and a tray 39 to receive and hold the recording paper 33, on which the original image has been reproduced.

The electrophotographic device of the above-described construction is operated in the following fashion. Referring to FIG. 7, the original image 25 on the fixed table 24 is illuminated by the lamp 26, and its image is irradiated on the screen 1 through the optical system 27. At the time of illuminating the abovementioned original image, the lamp 26, the optical system 27, and the container 31 move in parallel with and in the vicinity of the fixed photosensitive screen at the same speed and in the same direction, whereby the primary electrostatic image is formed on the screen 1. The conveyor belt 35 beneath the screen 1 is colored in a low brightness such as black so as to prevent light which has passed through the openings of the screen 1 from scattering to other parts of the device. The recording paper 33 is forwarded by the paper feeding roller 34 onto the conveyor belt 35 sheet by sheet, and is positioned by the conveyor belt 35 facing the screen 1 at the stage of the primary electrostatic latent image having been formed on the screen 1. Then, the flow of corona ions from the corona discharger 36 for the secondary electrostatic image formation is modulated by the primary electrostatic latent image on the screen 1 to thereby form the secondary electrostatic latent image on the recording paper 33. Thereafter, the secondary electrostatic latent image is developed by the developing means 37, and the developed image is fixed by the fixing means 38. The thus image reproduced recording paper 33 is received and held in the tray 39 outside the reproduction device. The corona discharger 36 is capable of increasing its moving speed higher than 30 cm/sec., hence it can be operated at a very high speed at the time of the retention copying.

For the purpose of the retention copying, the lamp 26, the optical system 27, and the container 31 are in the stationary state, only the corona discharger 36 moving above the screen 1. The operations of the discharger 36 and the recording paper 33 at this time are as follows. The recording paper stops at its designated position below the screen 1, when the corona discharger 36 comes along above the screen 1, whereby the secondary electrostatic latent image is formed on the recording paper. Immediately upon formation of the secondary electrostatic latent image on the recording paper 33, it is shifted toward the developing means 37 and the fixing means 38, and the next succeeding recording paper is fed to the position beneath the screen 1. In this case, before the paper comes to the designated position and steps, the corona discharger 36 returns to its starting position. In other words, at the time of the retention copying, only the corona discharger 36 moves among various means for the electrostatic latent image formation, hence the device becomes able to operate at a high speed and with small load imposed thereon.

Figure 9:
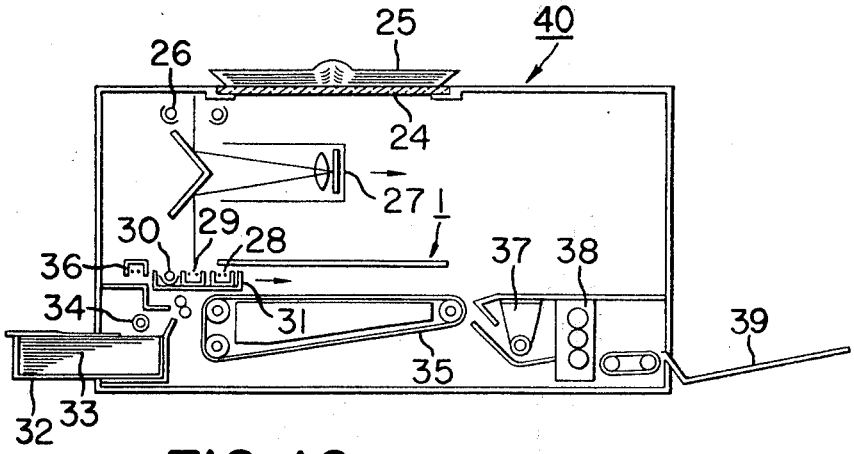
Figure 10:
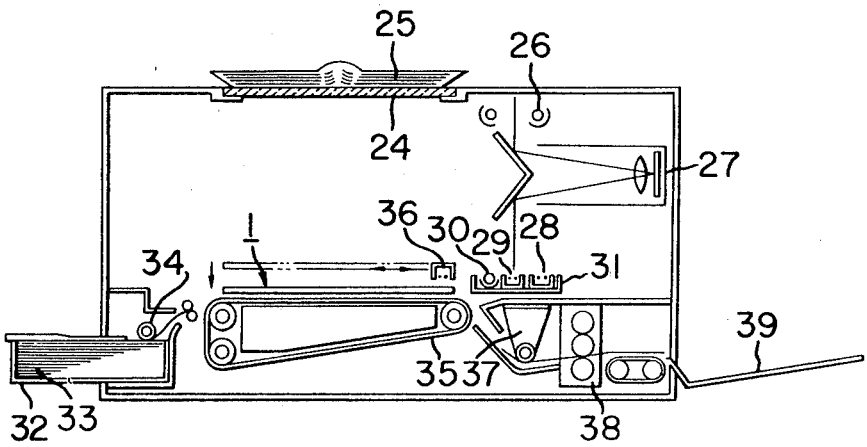

The electrophotographic reproduction device 40 shown in FIG. 9 is the same in the basic construction with the device 23 in FIG. 7. In this reproduction device, however, the screen 1 is so designed that it is shifted in close proximity to the conveyor belt 35 so as to narrow the space interval between the screen 1 and the recording paper 33 as shown in FIG. 10, whereby the flow of the corona ions from the corona discharger 36 for the secondary electrostatic latent image formation is modulated by the primary electrostatic latent image on the screen 1 to form the secondary electrostatic latent image on the recording paper 33. At the formation of the secondary electrostatic latent image, the screen 1 is maintained in a state of its having shifted in close proximity to the recording paper 33 as shown in FIG. 10, in the course of which the recording paper 33 is fed and brought to the designated position. As soon as the paper stops at the destination, the abovementioned corona discharger 36 begins to shift.

As stated in the foregoing, displacement of the photosensitive screen 1 in close proximity to the recording paper 33 makes it possible to reduce the electric voltage to be impressed on the corona discharger 36 to form the secondary electrostatic latent image lower than that in the device shown in FIG. 7. For example, when the distance between the screen 1 and the recording paper 33 is 20 mm, a voltage of 6 to 20 kV or so is necessary. However, when the distance therebetween is 3 mm, voltage application of 2 to 3 kV or so would be sufficient to form the secondary electrostatic latent image.

Figure 11:
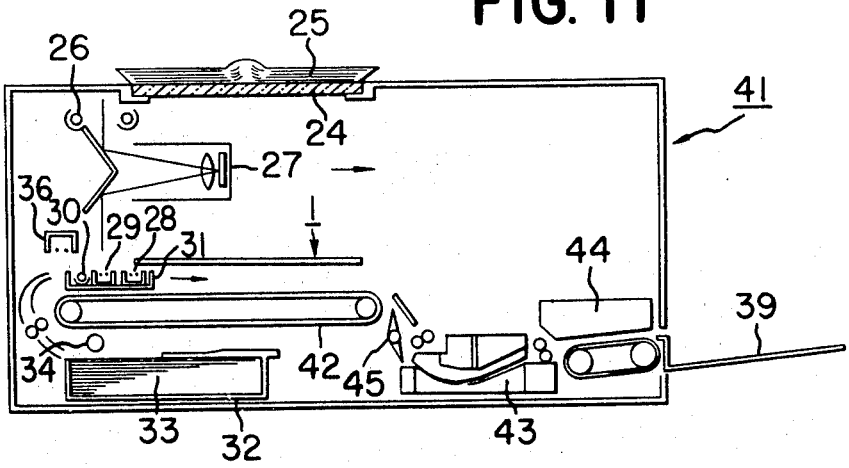
Figure 12:
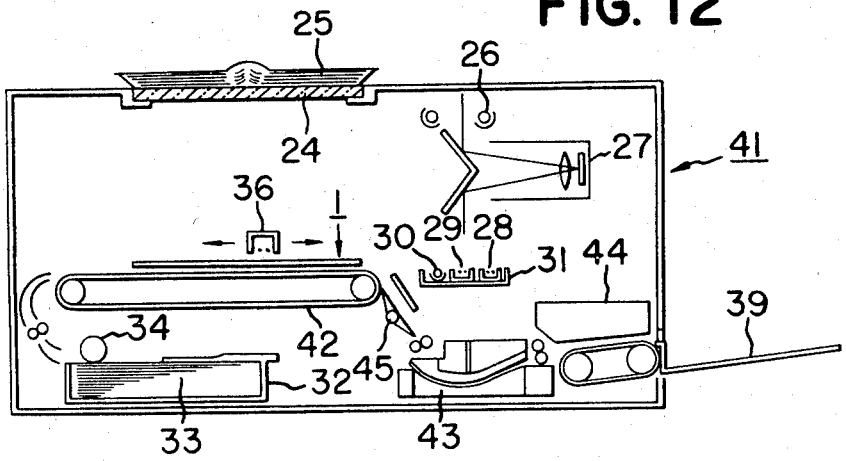

The electrophotographic reproduction device 41 shown in FIG. 11 is different from the device in FIG. 9 in that, upon formation of the primary electrostatic latent image, the conveyor belt 42 moves upward to the fixed screen 1 and stops immediately below the same as shown in FIG. 12. By thus narrowing the space interval between the screen 1 and the recording paper 33, the same effect as explained in the device of FIG. 9 can be attained. In FIG. 11, the developing vessel 43 is of a wet type, and the fixing means 44 is a chamber type, heat-drying fixing device. Also, the reference numeral 45 designates a separating pawl to separate the recording paper 33 from the conveyor belt 42. The separating pawl 45 and the guide members provided therearound move simultaneously with the conveyor belt 42. It will be convenient that the positional relationship of the separating pawl 45 be made changeable at a stage before and after the simultaneous shifting so that the pawl 45 may not touch the developing vessel 43 or other members. In the state as shown in FIG. 11, the tip end of the separating pawl 45 does not contact the conveyor belt 42, and the other end of the guide member is disposed at a position distant from the developing vessel 43. When the primary electrostatic latent image formation is complete, and the conveyor belt 42 moves upto the position immediately below the screen 1, the separating pawl 45 also moves and the tip end of this pawl is so actuated that it is in a state of readily separating the recording paper 33 on the conveyor belt 42 therefrom, while the other end of the separating pawl 45 exhibits its function to guide the recording paper 33 to the developing vessel 43.

Incidentally, in FIGS. 7 to 12 inclusive, the component members in the devices having the same functions are designated by like reference numerals.

Figure 13:
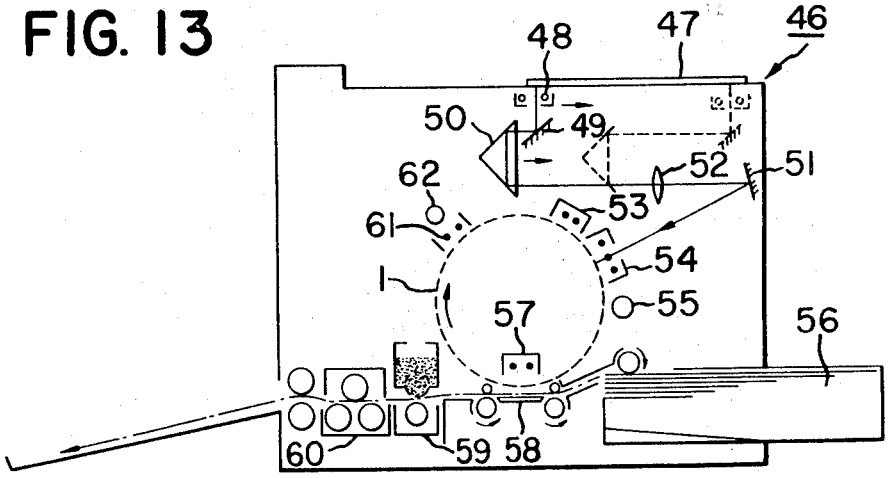

The reproduction device 46 shown in FIG. 13 forms the photosensitive screen 1 in a cylindrical shape. In this figure, the original image 47 placed on the fixed plate is illuminated by the lamp 48 and exposed on the cylindrical screen 1 by means of the optical system comprising mirrors 49, 50 and 51 and an optical lens 52. The screen 1 rotates in the clockwise direction as shown by an arrow, and has its conductive member inwardly exposed. The primary electrostatic latent image is formed on this cylindrical screen in such a way that, upon its passage through the corona discharger 53 for the primary voltage application and subsequently through the corona discharger 54, the screen is irradiated by the lamp 55 on the entire surface thereof. The electrostatic recording paper 56 which is the recording member is conveyed through the route indicated by a dot-and-dash line. The secondary electrostatic latent image is formed on the recording paper held on the conductive supporting member 58 by modulating the flow of the corona ions from the corona discharger 57 by the primary electrostatic latent image formed on the screen. After the secondary electrostatic latent image formation, the recording paper 56 is forwarded to the dry type developing vessel 59 and subsequently to the fixing vessel 60 where the latent image is developed and fixed, and the original image is thereby reproduced on the recording paper. When multiple reproductions are desired to be obtained from the single original image, the forming process of the secondary electrostatic latent image alone is carried out, while synchronizing the rotation of the screen 1 and the paper feeding. It is also possible to re-use the screen 1 after the primary electrostatic latent image which has become unnecessary is removed by the corona discharger 61 for removing the electric charge, and the lamp 62.

Figure 14:
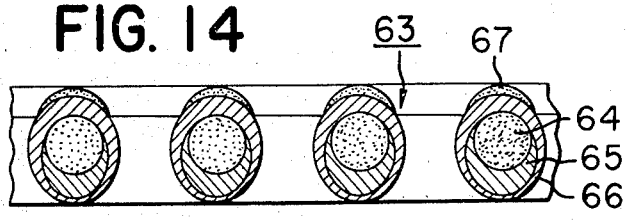
FIGS. 14 to 17 inclusive are respectively enlarged cross-sectional views of the modified photosensitive screens to be used for the present invention.
Figure 15:
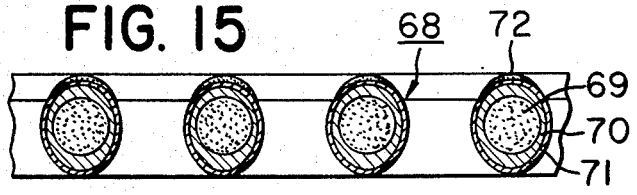

In the following, the construction of the screen capable of forming the primary and secondary electrostatic latent images by the electrostatic latent image forming process will be explained in reference to FIGS. 14 to 17 inclusive which indicate enlarged cross-section of the photosensitive screens according to the present invention. The screen 63 in FIG. 14 is in such a construction that a photoconductive member 65 is coated on the conductive member 64 to be the active part of the screen 63 at a portion substantially to one side thereof, a surface insulating member 66 is further coated on these partially exposed conductive member 64 and the photoconductive member 65 so as to wrap both parts, and a separate conductive member 67 which is different from the abovementioned conductive member is provided on one part of the surface insulating member 66. The conductive member 67 is deposited on the insulating member 66 by the vacuum-evaporation of metals such as aluminum, copper, gold, indium, nickel, and so forth, or by spray-coating of a mixture of a resin as a binder and a conductive resin containing therein quaternary ammonium salt, etc., carbon powder, or fine powder of metals such as silver, copper, etc. The screen 68 shown in FIG. 15 is substantially the same as the screen 63 in FIG. 14 with the exception that the photoconductive member 70 is provided around the conductive member 69 so as to surround it completely. In the screen 73 of FIG. 16, the photoconductive member 75 is provided around the conductive member 74 to be the base for the screen 73 in such a manner that a part of the conductive member 74 may be exposed, and also the surface insulating member 76 is provided on the photoconductive member 75 in such a manner that a part of the latter member may be exposed to the opening of the screen 73. Further, the screen 77 shown in FIG. 17 is so constructed that the insulating member 79, the photoconductive member 80, and the surface insulating member 81 are provided one after the other in such a manner that the conductive member 78 to be the base for the screen 77 may be exposed as is the case with each of the afore-described screens of varying structure. The materials and method to be used for fabricating the afore-described screens may be the same as those used in fabricating the screen 1 of FIG. 1.

The latent image forming processes using each of the above-explained screens will be described hereinbelow. However, as the processes are not much different from the case of the screen 1 shown in FIG. 1, only the outline of each step will be given. Also, throughout the explanation, the photoconductive member is the one that is exemplified in FIG. 1. Explanation of the screen 68 in FIG. 15 is disposed with in view of the explanation of the screen 63 in FIG. 14.

Figure 18:
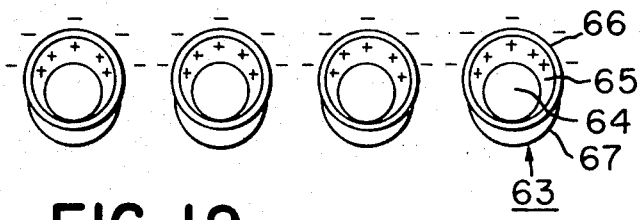
FIGS. 18 to 20 inclusive are respectively schematic diagrams to explain the formation of the primary electrostatic latent image on the modified screen shown in FIG. 14 above.
Figure 19:
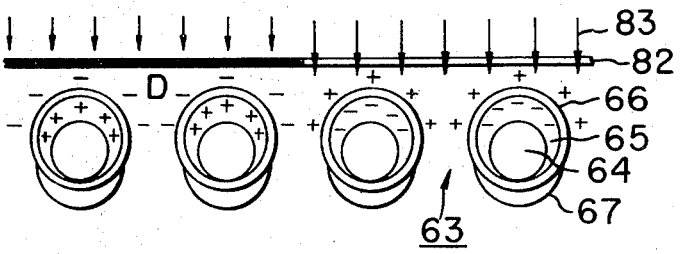
Figure 20:
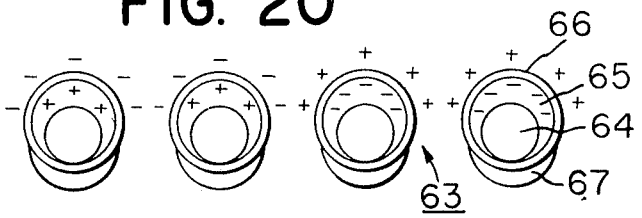

FIGS. 18 to 22 indicate the state of electric charge in the screen 63 of FIG. 14 due to the electrophotographic method according to the present invention, of which FIG. 18 shows the primary voltage application process to the screen 63, hence it indicates a state of the surface insulating member 66, for example, being uniformly charged in the negative polarity by the corona discharger. Owing to this electric charging, the surface of the surface insulating member 66 is negatively charged, whereby a positively charged layer which is the opposite polarity to that of the insulating member 66 is formed in the photoconductive member 65 at a position contiguous to the vicinity of the insulating member 66 of the conductive member 66. FIG. 19 shows a result of simultaneous image irradiation and the secondary voltage application processes having been carried out on the screen 63 which has undergone the abovementioned voltage application process. The reference numeral 82 designates an original image to be reproduced, wherein the part D is a dark image portion and the part L is a bright image portion. In this FIG. 19, the surface insulating member 66 is shown to be discharged by the corona discharger with an A.C. voltage as a power source, on which a voltage of the positive polarity has been superposed, in such a manner that the surface potential of the abovementioned insulating member 66 may be made in substantially the positive polarity. When the surface potential of the insulating member 66 is thus made in the opposite polarity to that at the time of the primary voltage application process, the surface potential of the insulating member 66 takes the positive polarity in the light image portion L, although the dark image portion D of insulating member 66 remains to be the negative polarity. FIG. 20 shows the result of conducting a uniform exposure on the entire surface of the screen 63 which has undergone the abovementioned respective process steps. By this overall exposure, the electric potential of the dark image portion D of the screen 63 changes its potential in proportion to the charged quantity on the surface of the insulating member 66. In this consequence, there is formed on the screen 63 the primary electrostatic latent image in conformity to the original image to be reproduced.

Figure 21:
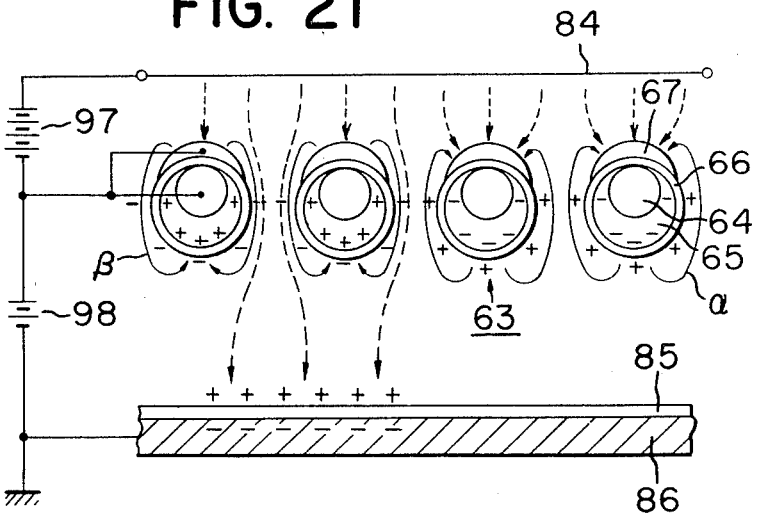
FIG. 21 is a schematic diagram to explain the forming process of the secondary electrostatic latent image by the photosensitive screen as shown in FIG. 14.

FIG. 21 shows a state of the secondary electrostatic latent image being formed on the recording member by way of the primary electrostatic latent image on the abovementioned screen 63. The reference numeral 84 in this figure designates the corona wire, the numeral 85 designates the recording member held on the conductive support member 86 which also functions as the opposite electrode to the corona wire 84. The corona wire 84 is impressed by a voltage of the positive polarity, and the conductive support member 86 is maintained at zero potential. The dotted lines in this figure show the ion flow from the corona wire 84. The principle of modulating the ion flow is as described in the foregoing with regard to the formation of the secondary electrostatic latent image shown in FIG. 5. Also, as mentioned previously, the image irradiation and the secondary voltage application may be carried out in sequence depending on the characteristic of the photoconductive substance constituting the screen. This holds good for other processes of the present invention as will be described hereinafter. Throughout the processes as described above, the conductive members 64 and 67 are electrically continuous, and they are able to adjust the passing ion flow at the time of modulating the corona ion flow by impressing a bias voltage.

FIGS. 70 to 74 inclusive indicate respectively the charged states in the screen which, unlike that explained with reference to FIG. 1, does not cause the carrier injection at the time of the primary voltage application. FIG. 75 is a graphical representation showing variations in the surface potential of the screen in each process step in FIGS. 70 to 74 above. The screen 204 in FIG. 70 possesses the conductive member 208 provided at only one surface side of the conductive member 205 to be the basic element for the screen 204, the photoconductive member 206, the insulating member 207 and the screen 204 per se. This figure shows the primary voltage application process to the abovementioned screen 204 by way of the corona wire 209 and the power source 210. In the illustrated example, the abovementioned screen 204 is in a state of being charged in the positive polarity at the dark image portion D. In the above-described process step, positive electrostatic charge is adhered onto the insulating member 207. However, as the photoconductive member 206 exhibits highly insulative property, no negative charge layer corresponding to the positive electrostatic charge can be formed.

Figure 72:
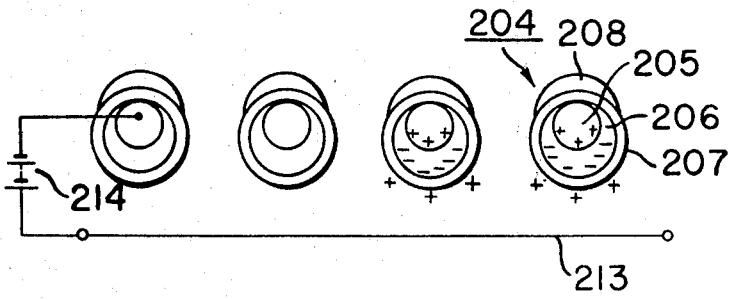

FIG. 71 indicates the image irradiation process, wherein the original image 211 is irradiated by light 212 for the exposure. By this image irradiation process, the photoconductive member 206 at the bright image portion of the screen 204 lowers its resistance value with the consequent formation of a negative charge layer corresponding to the abovementioned positive static charge in the neighborhood of the insulating member 207 contiguous to the photoconductive member 206. FIG. 72 shows a result of applying onto the dark image portion of the abovementioned screen 204 a secondary voltage having a polarity opposite to that of the primary voltage by means of the corona wire 213 and the power source 214. For the purpose of the latent image formation, the secondary voltage may either be of the same polarity as that of the primary voltage, or be an alternate current. By this secondary voltage application process, the electric potential at the dark image portion on the screen 204 becomes zero, while, at the bright image portion, the positive charge on the surface of the screen is eliminated to some extent.

Figure 73:
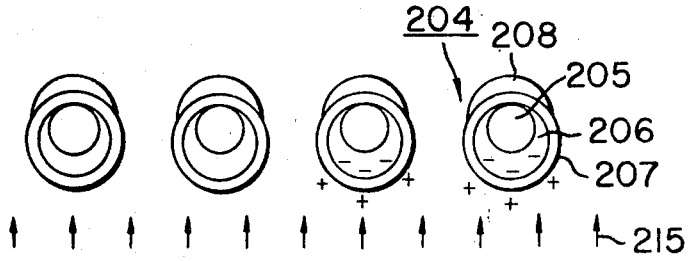

FIG. 73 shows a result of the overall surface exposure of the abovementioned screen 204, whereby the primary electrostatic latent image having high electrostatic contrast is formed on the screen 204. The reference numeral 215 designates the exposure light.

Figure 74:
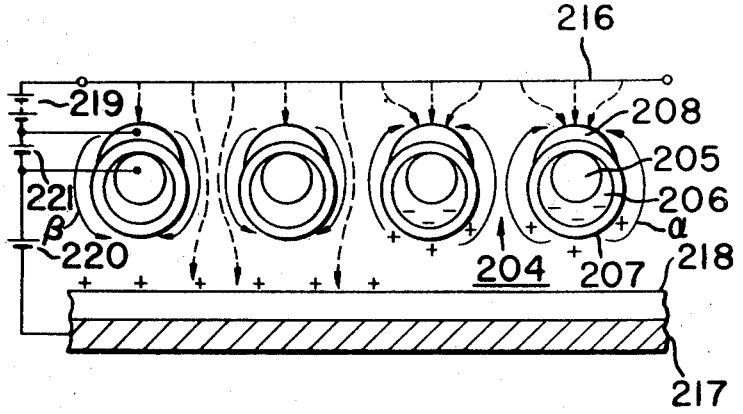
FIG. 74 is a schematic diagram to explain the forming process of the secondary electrostatic latent image by the same screen.
Figure 75:
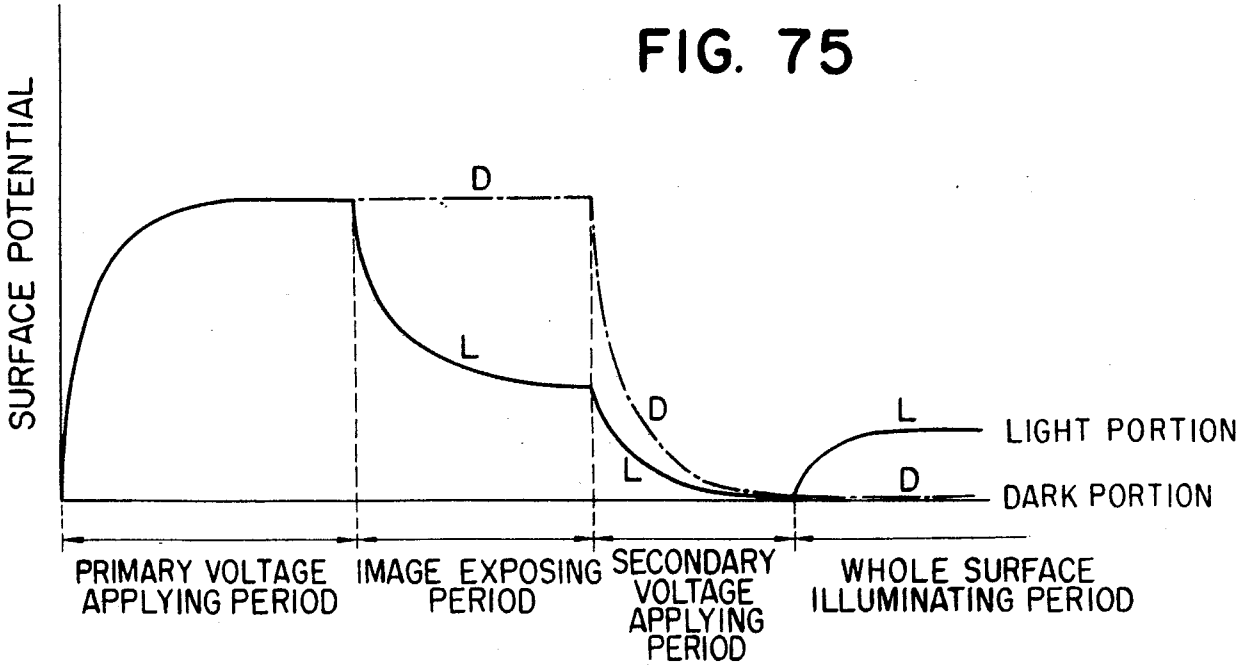
FIG. 75 is a graphical representation showing the surface potential curve of the screen in the image forming steps shown in FIGS. 70 to 73.

FIG. 74 shows the secondary electrostatic latent image forming process by way of the abovementioned screen 204. In this figure, the reference numeral 216 designates the corona wire, the numeral 217 designates the conductive support member, the numeral 218 the recording member, the numeral 219 the power source for the corona wire, and the numeral 220 the power source for forming a bias field between the screen 204 and the recording member 218. When the flow of the corona ions as indicated by the dotted lines in the drawing and having the same polarity as that of the surface charge at the bright image portion of the screen 204 is directed to the recording member 218, the ion flow is modulated by the primary electrostatic latent image on the screen 204, and the secondary electrostatic latent image is formed on the recording member 218. In order for the ion flow to be satisfactorily modulated, formation of a bias field by the electrode 221 between the conductive members 205 and 208 may be effective. In this secondary electrostatic latent image forming process, the image irradiation and the secondary voltage application cannot be performed simultaneously.

Figure 16:
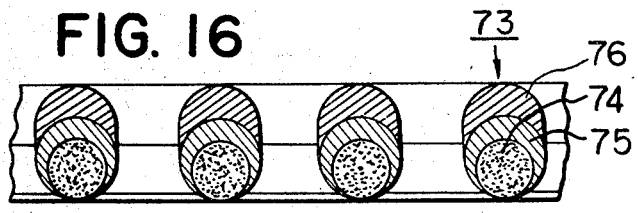
Figure 17:
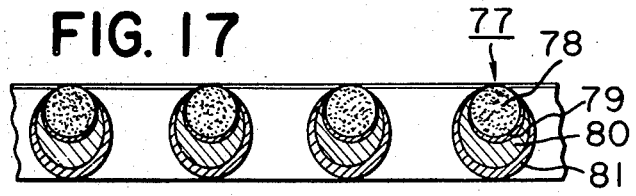
Figure 22:
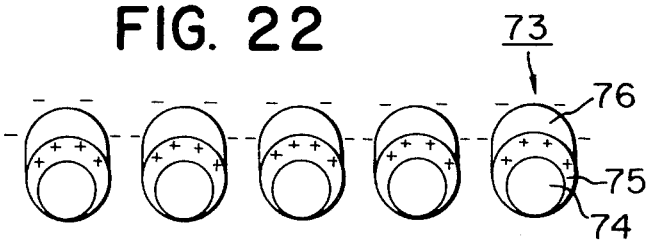
FIGS. 22 to 24 inclusive are respectively schematic diagrams to explain the forming processes of the primary electrostatic latent image on the modified screen shown in FIG. 16.
Figure 23:
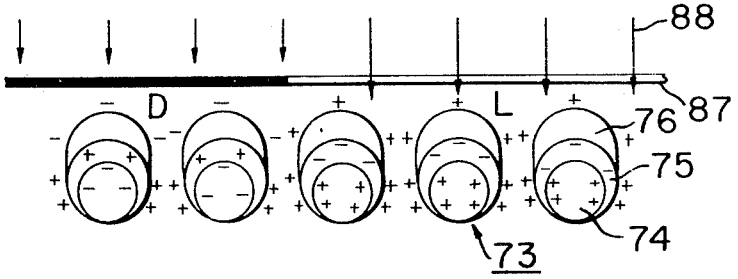
Figure 24:
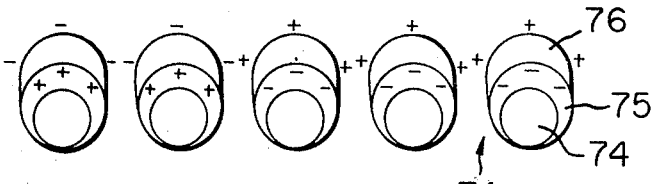
Figure 25:
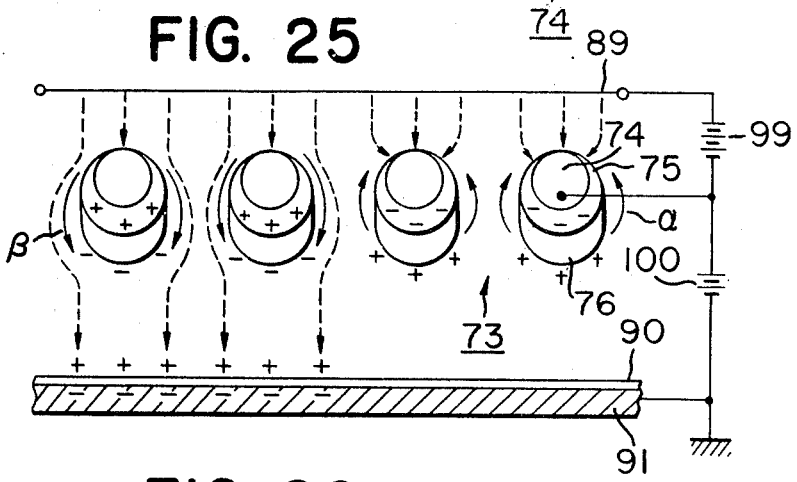
FIG. 25 is a schematic diagram to explain the forming process of the secondary electrostatic latent image by the same screen as shown in FIG. 16.

Turning now back to the previous figures of the drawing, FIGS. 22 to 25 indicate respectively a state of the electric charge on the screen 63 of FIG. 16 for use in the electrophotographic process according to the present invention. FIG. 22 shows the primary voltage application process to the screen 73, wherein the surface insulating member 76 is indicated to be charged in the negative polarity by the corona discharger. By the abovementioned charging, an electric charge layer of the positive polarity which is opposite to the charge polarity on the insulating member 76 is formed on the photoconductive member 75 at a position contiguous to the insulating member 76. FIG. 23 indicates a result of performing the simultaneous image irradiation and the secondary voltage application onto the screen 73, wherein the reference numeral 87 designates the original image to be reproduced, the reference letter D designates a dark image portion, the letter L a bright image portion, and the numeral 88 the light for exposure. FIG. 23 indicates a result of discharging the screen 73 by the corona discharger using an A.C. power source, on which a voltage of the positive polarity has been superposed, in such a manner that the surface potential of the screen 73 may take substantially the positive polarity. As the consequence of this corona discharge, the surface potential of the insulating member 76 can be made in the opposite polarity to the previous process step, although the surface potential of the insulating member 76 at the dark image portion D remains to be in the negative polarity. Also, the photoconductive member 75 exposed to the openings of the screen 73 in some occasion has the electric charge adhered on its surface due to the secondary voltage application in case no sufficient light reaches the photoconductive member 75. FIG. 24 indicates a result of carrying out sufficient exposure to the overall surface of the screen 73 which has undergone the aforementioned respective process steps. By this light exposure, the dark image portion D of the screen 73 changes its electric potential in proportion to the charge quantity on the surface of the insulating member 76, as the result of which the primary electrostatic latent image is formed on the screen 73 in conformity to the original image to be reproduced. FIG. 25 indicates formation of the secondary electrostatic latent image on the recording member, wherein the recording member 90 is held on the conductive support member 91. The flow of corona ions generates from the corona wire 89 as indicated by the dotted lines in the drawing and is directed to the recording member 90 passing through the primary electrostatic latent image on the screen 73 where it is modulated. Incidentally the conductive support member 91 serves also as the opposite electrode. The corona wire is impressed by a voltage of the positive polarity. The principle of modulating the ion flow shown in the dotted lines is as already explained in respect of the secondary electrostatic latent image forming process of FIG. 5.

Figure 26:
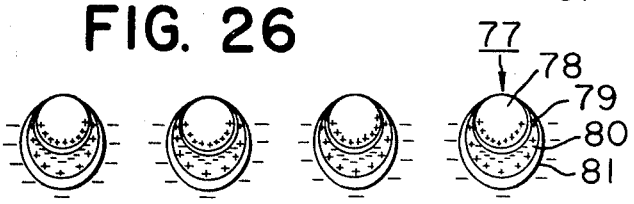
FIGS. 26 to 28 are respectively schematic diagrams to explain the forming processes of the primary electrostatic latent image by the modified screen shown in FIG. 17.
Figure 27:
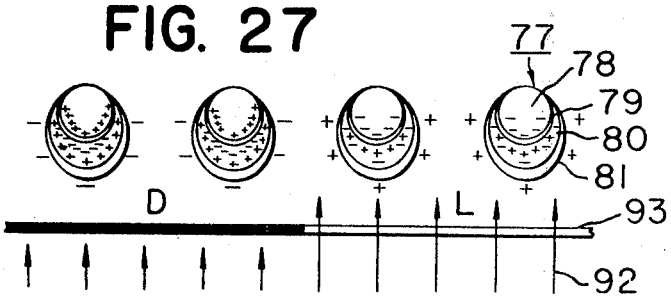
Figure 28:
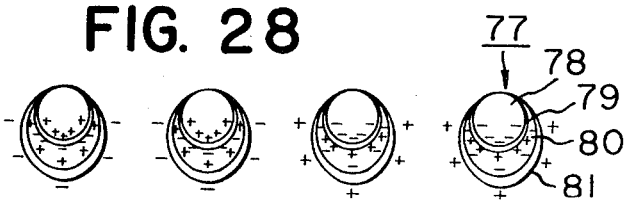
Figure 29:
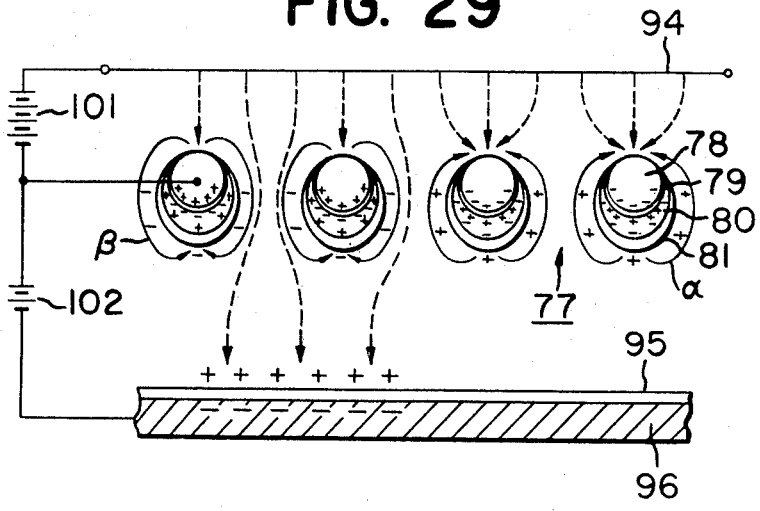
FIG. 29 is a schematic diagram to explain the forming process of the secondary electrostatic latent image by the same screen as shown in FIG. 17.

FIGS. 26 to 29 inclusive respectively indicate a state of electric charge on the screen 77 in FIG. 17 by the electrophotographic process according to the present invention. As illustrated in FIG. 26, the primary voltage application charges the surface insulating member 81 in the negative polarity. By the abovementioned electric charging, the carrier existing in the interior of the photoconductive member 80 moves, or the carrier formed by the overall exposure, etc. of the screen to be carried out simultaneously with the electric charging moves toward the surface insulating member 81, and the abovementioned carrier of the positive charge is captured at the interface between the photoconductive member 80 and the insulating member 81. In this consequence, the charge layer is formed in the interior of the screen 77. FIG. 27 indicates a result of conducting the simultaneous image irradiation and the secondary voltage application on the screen 77 which has undergone the abovementioned primary voltage application process, wherein the original image 93 having the dark image portion D and the bright image portion L is irradiated by exposure light 92 represented by arrows. Same as mentioned in the foregoing, FIG. 26 also indicates a result of discharging the screen 77 by use of the corona discharge with an A.C. voltage, on which a voltage of the positive polarity has been superposed, as the power source in such a way that the surface potential of the abovementioned insulating member 81 may become substantially the positive polarity. As described above, at the time of the secondary voltage application, the surface potential of the insulating member 81 takes an opposite polarity to that of the primary voltage application, although, at the dark image portion D of the insulating member 81, there still remains the negative charge on the surface thereof. FIG. 28 shows a result of conducting a uniform, overall exposure to the screen 77. By this overall exposure of the screen, the electric potential at the dark image portion D of the screen 77 varies in proportion to the charge quantity on the surface of the insulating member 81, in consequence of which the primary electrostatic latent image is formed on the screen 77 in conformity to the original image to be reproduced. FIG. 29 indicates the secondary electrostatic latent image being formed on the surface of the recording member 95 which is held on the conductive support member 96 which also serves as the opposite electrode to the corona wire 94. The corona wire 94 is impressed by a voltage of the positive polarity. The principle of the ion flow modulation as indicated by the dotted lines is as already described in the secondary electrostatic latent image forming process of FIG. 5.

Figure 30:
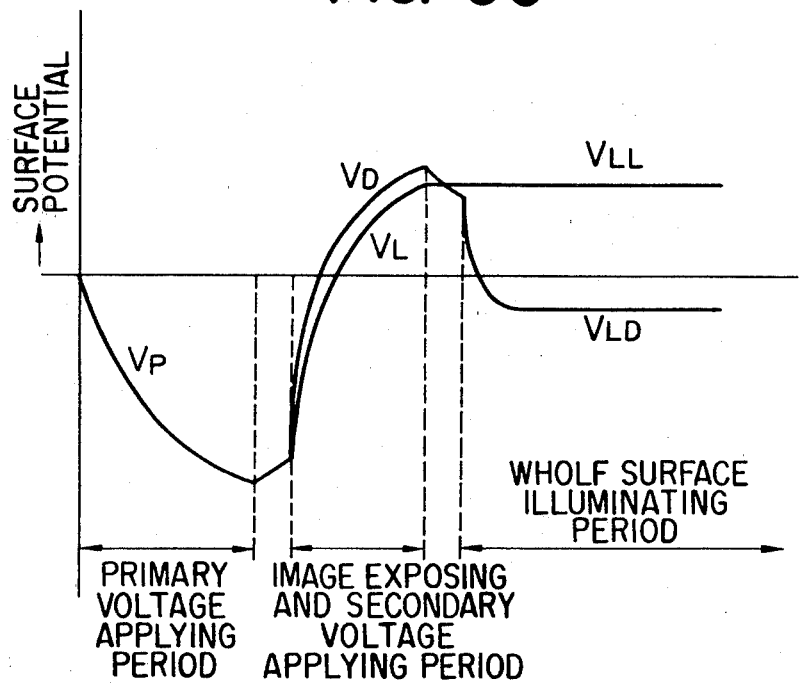
FIG. 30 is a graphical representation showing curves of the surface potential of the screen in FIG. 17 at the time of forming the primary electrostatic latent image.

FIG. 30 shows the potential curves on the surface of the insulating member at each process step of forming the electrostatic latent image as described in the foregoing. As will be seen from this graphical representation, when the surface of the insulating member of the screen is charged in the negative, for example, by the corona discharger, the surface potential of the insulating member lowers with lapse of the charging time to indicate the characteristic as represented by the curve $V_p$. Next, when the image irradiation and the recharging with A.C. corona discharge biased in the positive polarity to some extent are carried out, the negative charge in the bright image portion of the image is entirely discharged to be charged in substantially the positive polarity as represented by the characteristic curve $V_L$. Also, in the dark image portion, the negative charge formed on the surface of the insulating member by the abovementioned charging is not discharged completely as in the bright image portion, even if the abovementioned secondary voltage application is carried out, hence the surface potential in the dark image portion is as shown by the characteristic curve $V_D$. Thus, when the overall surface exposure of the screen is conducted after the image irradiation and the secondary voltage impression to form the electrostatic latent image on the surface of the insulating member, no remarkable change takes place in the abovementioned bright image portion of the photoconductive member, so that the surface potential becomes as shown by the curve $V_{LL}$. On the contrary, in the abovementioned dark image portion, the resistance value of the photoconductive member lowers abruptly to become conductive, as the result of which the electric charge within the photoconductive member remains to be slightly captured by the negative charge field on the surface of the insulating member, and the surface potential thereof abruptly reduces as represented by the characteristic curve $V_{DL}$. Through the foregoing process steps, the primary electrostatic latent image is formed on the screen.

In FIGS. 21, 25, and 29, the reference numerals 97 to 102 designate the power source for the corona wire, the screen, and the conductive support member. Also, in the formation of the primary electrostatic latent image on the abovementioned screens 63, 68, 73, and 77, the voltage used for the secondary voltage application process may be one having the opposite polarity to that used for the primary voltage application, besides the A.C. voltage, on which a D.C. voltage is superposed as mentioned above. Further, as to the direction of the image irradiation, it can be done from the side where the conductive member is exposed, besides the aforementioned direction. In this case, however, if the screen to be used is of such construction as shown in FIGS. 14 and 15 (the screen 63 and 68) that another conductive member is further provided on the surface insulating member, it is necessary that the conductive member be also made of a transparent material. It goes without saying that the retention copying is feasible even in the case of using such screen.

Figure 31:
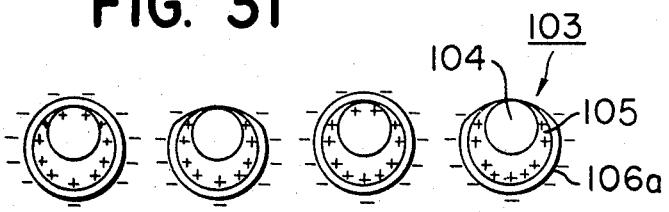
FIGS. 31 to 34 inclusive are respectively schematic diagrams to explain the forming processes of the primary electrostatic latent image on the screen.

The screen as mentioned in reference to FIG. 31 differs from the screens as has been described hereinbefore in that it shows the insulative property at its one surface side due to the surface insulating member 106, and, at its other surface side, it has both conductive portion and the insulative portion. This screen 103 as shown in the figure is basically constructed by the conductive member 104 to be the base for the screen, the photoconductive member 105 provided around the conductive member 104, and the surface insulating member 106. The forming material of the screen 103 can be the same as that used in the screen of FIG. 1. The fabrication of the screen can be done, for example, by forming the insulating member 106 in such a manner as to surrounding the conductive member 104 and the photoconductive member 105, and then by grinding the only one surface side of the screen 103 by an appropriate grinding means. In particular, when the conductive member 104 has ups and downs in its cross-section as in the case of a metal net, if the one surface side of the screen 103 is ground uniformly, the higher portion thereof is ground, resulting in the construction as illustrated. The latent image forming process with the abovementioned screen 103 is almost same as mentioned in the foregoing, the outline of which will be given hereinbelow.

Figure 32:
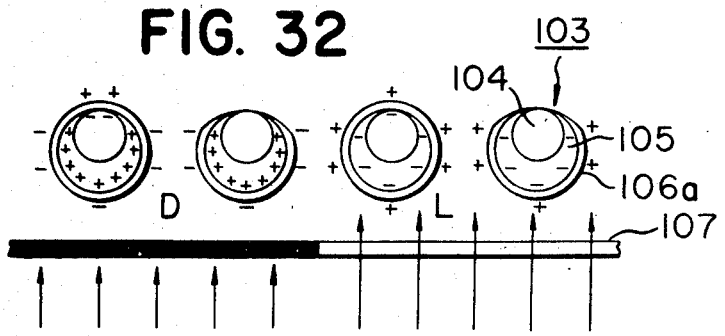
Figure 33:
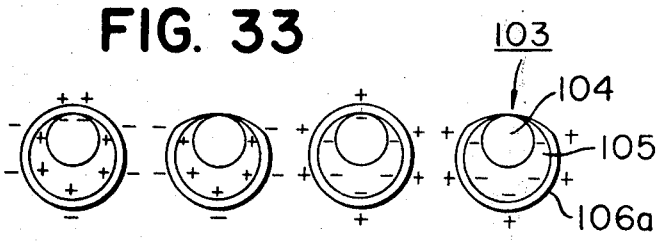

FIGS. 31 to 35 respectively indicate the state of the electric charge in the screen 103 of FIG. 31 by the processes substantially same as the afore-described electrophotographic processes. FIG. 31 indicates the primary voltage application to the screen 103, in which the surface insulating member **106*a* is shown to have been charged uniformly in the negative polarity, for example, by the corona discharger. By the abovementioned electric charging, the surface of the insulating member 106*a* is charged in the negative polarity, whereby a charge layer having the positive polarity which is opposite to that of the electric charge on the insulating member 106*a* is formed in the photoconductive member 105 at the position in the vicinity of the insulating member 106*a*. FIG. 32 shows a result of conducting the simultaneous image irradiation and the secondary voltage application onto the screen 103 which has undergone the primary voltage application, wherein the reference numeral 107 designates the original image having the dark image portion D and the bright image portion L, and the numeral 108 (arrows) designates the light for exposure. In this FIG. 32, the electric discharge is conducted by the corona discharger using an A.C. voltage power source, on which a voltage of the positive polarity is superposed, or a power source of a voltage having the opposite polarity to that used in the primary voltage application. The discharge is carried out in such a manner that the surface potential of the abovementioned insulating member 106***a* may become substantially the positive polarity. In this case, as the photoconductive member 105 in the dark image portion D has a high resistance, the surface charge of the insulating member 106*a* remains negative due to the abovementioned charge layer. FIG. 33 shows a result of conducting the uniform exposure on the entire surface of the screen 103 which has undergone the afore-mentioned process steps. By this exposure, the potential at the dark image portion D of the screen 103 varies in accordance with the electric charge quantity on the surface of the insulating member 106*a*. As the result of this, the primary electrostatic latent image is formed on the screen 103 in conformity to the original image.

Figure 34:
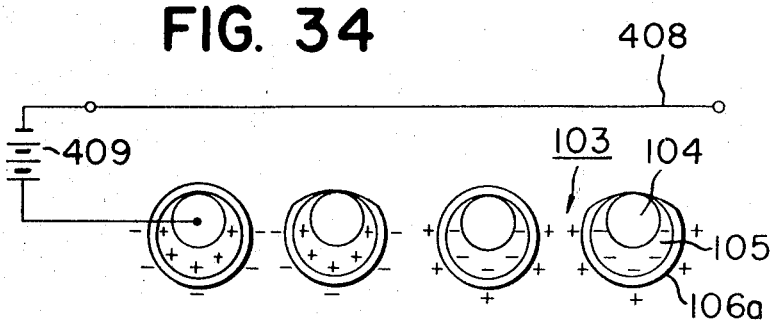

FIG. 34 shows the process for removing unnecessary electric charge on the insulating member 106*a* existing on the exposed surface side of the conductive member of the abovementioned screen. This process can be dispensed with. The reference numeral 408 in this figure designates the corona wire, and the numeral 409 represents the power source for the corona wire 408. The polarity of the voltage to be applied onto the corona wire 408 may be selected from A.C. voltage, D.C. voltage, and so forth which are capable of eliminating the abovementioned unnecessary electric charge. Incidentally, this unnecessary charge is considered to be formed at the time of the primary and secondary voltage applications. This unnecessary charge removal needs not be done every time in the case of the retention copying.

Figure 35:
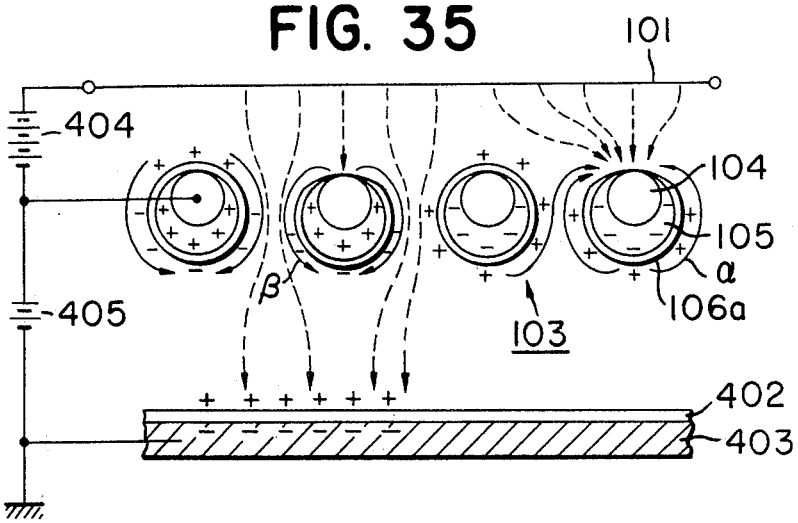
FIG. 35 is a schematic diagram to explain the forming processes of the secondary electrostatic latent image by the screen.

FIG. 35 indicates a state of forming the secondary electrostatic latent image to the recording member, wherein the latent image is formed on the recording member 402 held on the conductive support member 403 by way of the corona wire. This conductive support member 403 also serves as the opposing electrode to the corona wire 404. This corona wire is impressed by a voltage of the positive polarity, and the electric potential on the conductive support member 103 is maintained at zero. The principle of modulating the ion flow as indicated by the dotted lines is the same as already explained with regard to the secondary electrostatic latent image forming process of FIG. 5. In the drawing, the reference numerals 404 and 405 designate the power source to the corona wire 401 and the screen 103, respectively.

The electrophotographic process according to this second embodiment comprises the primary voltage application process to uniformly charge the screen according to the present invention for the purpose of the primary electrostatic latent image formation, the image irradiation process, and the second voltage application process to be conducted thereafter to vary the surface potential of the screen in accordance with the dark and bright patterns due to the abovementioned image irradiation. The screen to be used in this electrophotographic process is the same as that mentioned in the first embodiment. Here, the electrophotographic process will be explained in reference to FIGS. 36 to 39 using the screen 63 of the construction as shown in FIG. 14. The screen 106 to be used in this embodiment consists of the conductive member 107 to be the base for the screen, the photoconductive member 108, the surface insulating member 109, and the conductive member 110 provided only at one surface side of the screen 106. The substance to be used for the photoconductive member 108 is either those that do not cause the carrier injection by the primary voltage application, or those that do not form the electric charge layer in the photoconductive member 108 at a position in the vicinity of the insulating material depending on the kind of charge.

Figure 36:
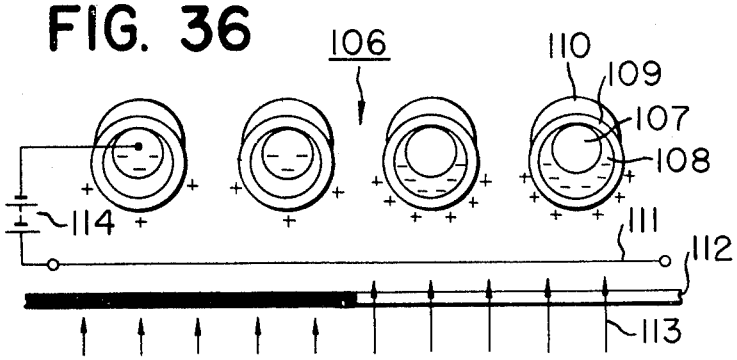
FIGS. 36 to 38, and FIGS. 40 to 42 inclusive are respectively schematic diagrams to explain the forming processes of the primary electrostatic latent image on the screen.

FIG. 36 indicates the simultaneous image irradiation and the primary voltage application processes, wherein the surface insulating member 109 is charged, for example, in the positive polarity by the corona wire 111 through the power source 114, and the original image 112 having the dark image portion D and the bright image portion L is irradiated by exposure light 113 in the arrow direction. By this electric charging, the positive charge is accumulated on the surface of the insulating member 109, and, particularly, a negative charge layer is formed in the photoconductive member 108 at the bright image portion in the vicinity of the insulating member, while, at the dark image portion, the electric charge varies in proportion to the capacity of the photoconductive member 108, as it is insulative.

Figure 37:
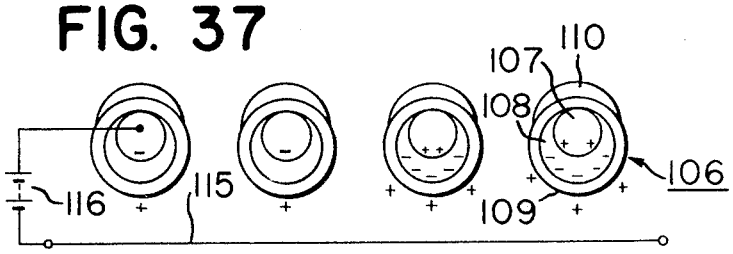

FIG. 37 indicates the secondary voltage application by the corona wire 115 and the power source 116 therefor. In this voltage application process, there is applied a voltage of a direction to eliminate the electric charge on the insulative member 109. The voltage to be applied is either an A.C. voltage, or a voltage having the opposite polarity to that in the primary voltage application. As the result of this, both bright and dark image portions of the screen 106 take the same surface potential.

Figure 38:
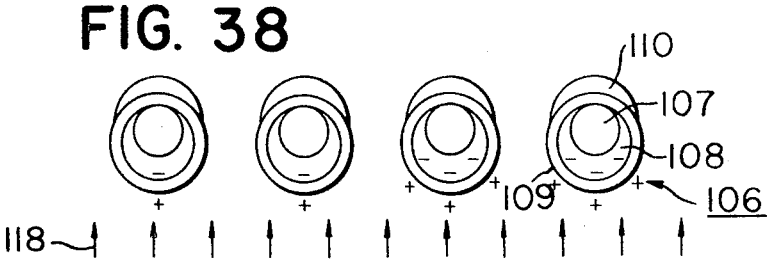

FIG. 38 indicates a result of conducting a uniform exposure with light 118 in the arrow direction over the entire surface of the screen 106. By this total exposure, the electric charge within the screen 106 moves again, and the electrostatic contrast increases, whereby the primary electrostatic latent image is formed on the screen.

Figure 39:
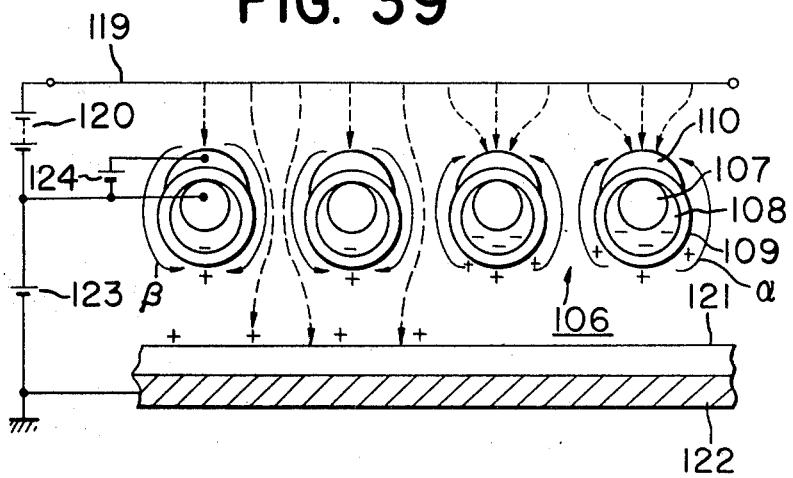
FIGS. 39 and 43 are respectively schematic diagrams to explain the forming processes of the secondary electrostatic latent image by the same screen.

FIG. 39 shows the secondary electrostatic latent image forming process. The principle of modulating the ion flow shown in the dotted lines is the same as that already mentioned in respect of FIGS. 5 and 21, hence detailed explanations are dispensed with. In this FIG. 39, the reference numeral 119 designates the corona wire, the numeral 120 the power source for the corona wire 119, the numeral 121 the recording member held on the conductive support member 122, the numeral 123 represents the power source for forming the bias field between the screen 106 and the conductive support member 122, and 124 designates the power source for forming the bias field between the conductive members 107 and 110. As mentioned above, when the bright and dark image portions are not in mutually the opposite polarity as in the screen 106, and the primary electrostatic latent image can be formed in the same polarity, it is effective to intensify the accelerating and inhibiting fields by forming the bias field between the conductive members 107 and 110 in the screen 106 of the above-described construction.

FIGS. 40 to 43 inclusive indicate application of the secondary voltage having the same polarity as that of the primary voltage application to the screen 106. On account of this application of the voltage having the same polarity, the primary electrostatic latent image as formed becomes high in its contrast. However, by adjusting the bias voltage to be applied between the conductive members 107 and 110, the secondary electrostatic latent image having less fog can be obtained.

Figure 40:
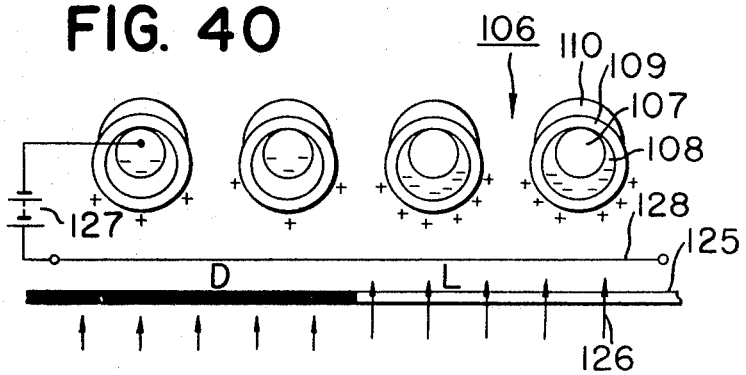

In FIG. 40, the primary voltage application is carried out onto the screen 106 by means of the corona wire 128, the power source 127, and the exposure light 126 in the arrow direction to illuminate the original image 125 having the dark image portion D and the bright image portion L. By this primary voltage application, if the screen 106 is charged, for example, in the positive polarity, it is again impressed by the voltage of the same positive polarity in the subsequent secondary voltage application as shown in FIG. 41.

Figure 41:
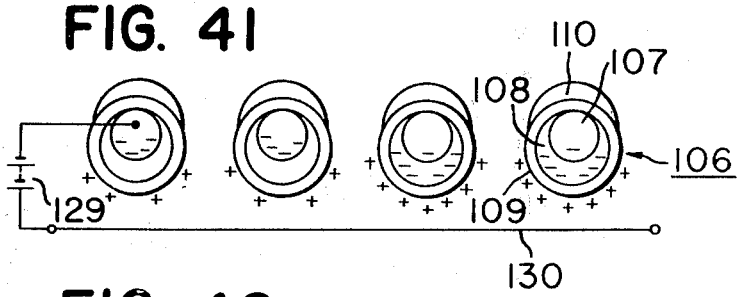
Figure 42:
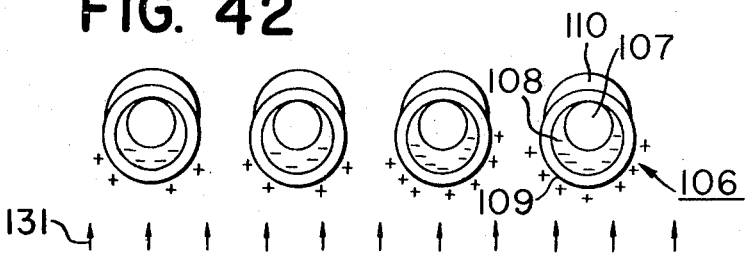
Figure 43:
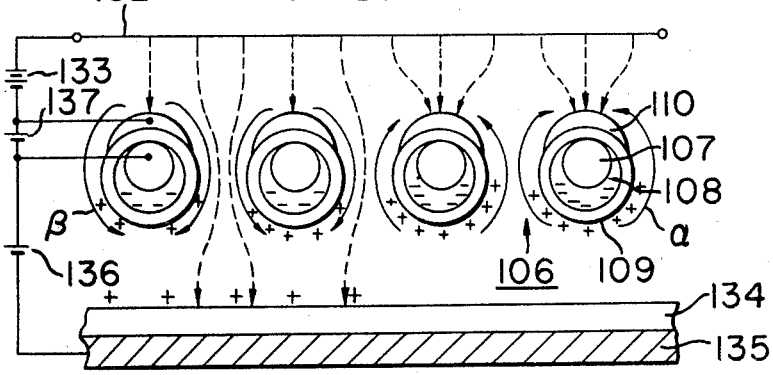

In FIG. 41, the reference numeral 129 designates the power source for the corona wire 130. FIG. 42 indicates a result of conducting a uniform exposure over the entire surface of the abovementioned screen 106 by the exposure light 131 in the arrow direction, whereby the primary electrostatic latent image is formed on the screen 106. FIG. 43 indicate the secondary electrostatic latent image forming process, wherein the reference numeral 132 designates the corona wire, the numeral 133 the power source for the wire, the numeral 134 the recording member, the numeral 135 the conductive support member, the numeral 136 the power source for forming the bias field between the conductive member 107 and the conductive support member 135, and the numeral 137 represents the power source for forming the bias field between the conductive member 107 and 110.

Figure 44:
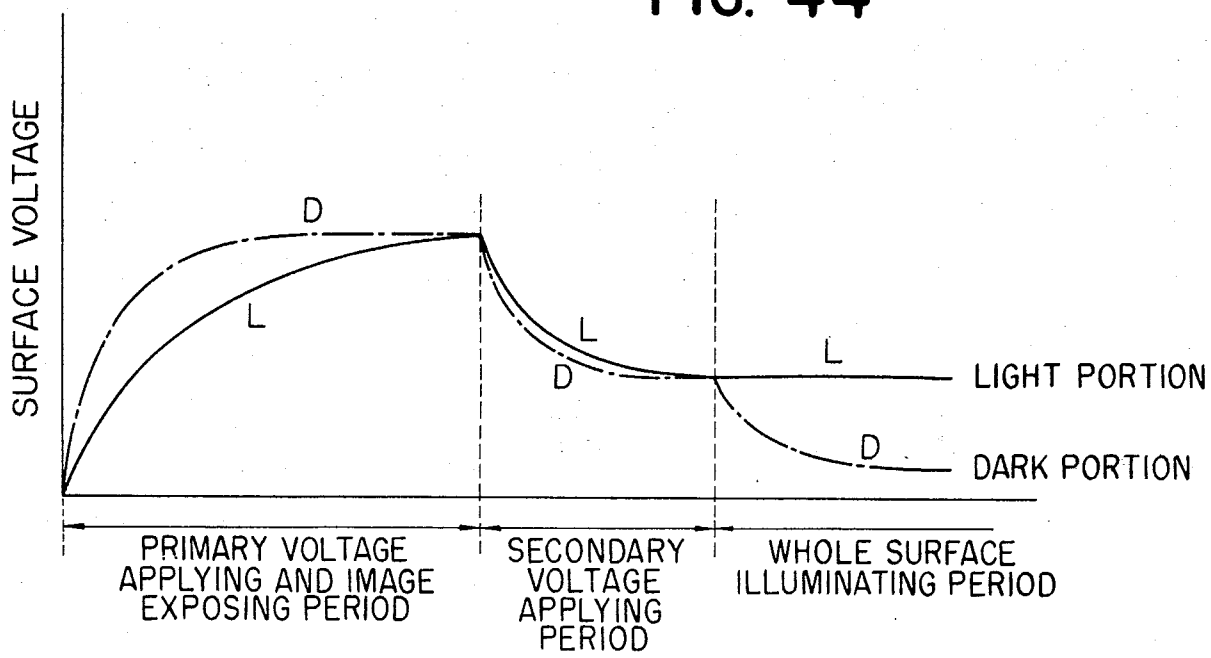
FIG. 44 is a graphical representation of the surface potential on the screen at every process step shown in FIGS. 36 to 39.

FIG. 44 shows the surface potential curves which varies on the screen surface in each process step as shown in FIGS. 36 to 38 inclusive.

Third Embodiment

The photoconductive member is formed on one surface of the conductive member as the base for the screen, which is made of stainless steel wire of 30 microns in diameter in the form of a metal wire net of 200 mesh size, by vacuum-evaporation of selenium (Se) containing therein 5% of tellurium (Te) to a thickness at the thickest portion thereof of approximately 50 microns. Subsequently, from both surfaces of the screen, a solution of a copolymer of vinyl chloride and vinyl acetate in methyl isobutyl ketone is spray-coated to a thickness of approximately 15 microns to form the insulating member on the photoconductive member. Thereafter, aluminum is deposited by evaporation to a thickness of 2,000 augstroms onto the surface side of the screen opposite to that where selenium is coated by evaporation, whereby the screen for use in the electrophotographic process according to the present invention is fabricated.

The image exposure is conducted from the surface side of the screen coated with selenium with the amount of the exposure light at the bright image portion being about 6 lux/sec. accompanied by the simultaneous corona discharge at +7 kV. After this, when an A.C. corona discharge of 6.5 kV is applied to the screen as the secondary voltage application process followed by the total surface exposure, the primary electrostatic latent image having the surface potential of approximately 0 V at the dark image portion and approximately +250 V at the bright image portion is formed. Then, the electrostatic recording paper is disposed facing the primary electrostatic latent image surface of the screen at a space interval of 3 mm between them. The stainless steel wire as the conductive member of the screen is earthed, the aluminum layer deposited on the screen is impressed by a voltage of +180 V, while the recording paper is impressed by a voltage of −3 kV, and the corona discharge of +7 kV is applied from the side of the screen opposite to the side thereof facing the recording paper so as to form the secondary electrostatic latent image. Upon formation of the secondary electrostatic latent image on the recording paper, it is developed by a liquid developer to obtain a clear positive image of the original. When the retention copying is conducted for 100 times using this secondary electrostatic latent image on the recording paper, the decrease in the image density in the 100th sheet is recognized to be less than 10% with respect to the image density in the initial sheet, the reproduced image of which is found serviceable for the practical use.

This third embodiment of the electrophotographic process according to the present invention comprises the primary voltage application to uniformly charge the abovementioned screen, and the image irradiation process to be conducted simultaneously with the primary voltage application. In the explanations of the electrophotographic process in this embodiment, the screen to be referred to is the same as that shown in FIG. 36 above in its construction and the electrical characteristics.

Figure 45:
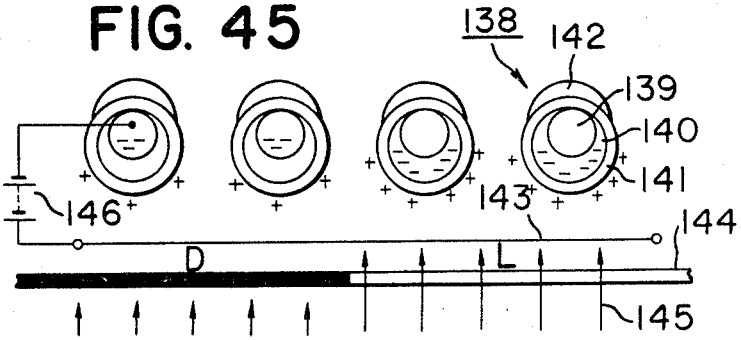
FIGS. 45 and 46 are respectively schematic diagrams to explain the forming processes of the primary electrostatic latent image on the screen.
Figure 46:
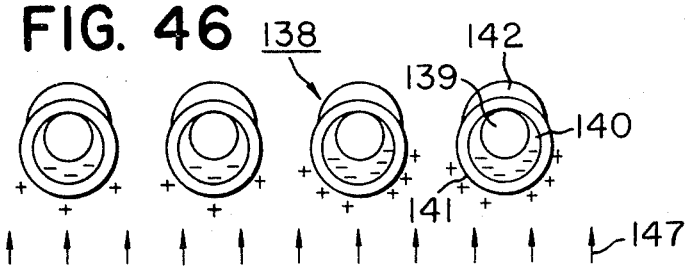
Figure 47:
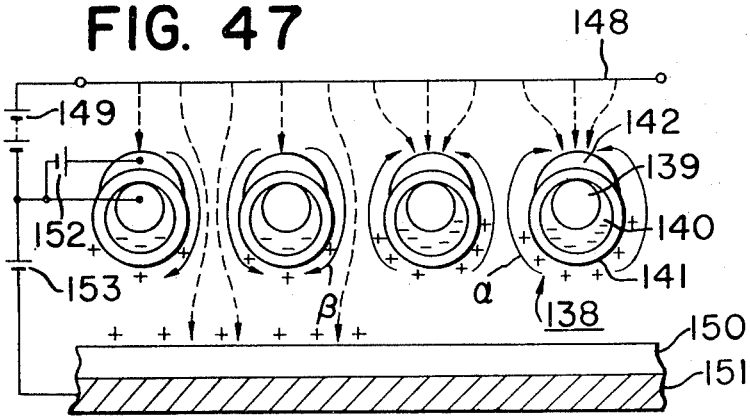
FIG. 47 is a schematic diagram to explain the forming process of the secondary electrostatic latent image by the screen.

Referring to FIGS. 45 to 47 inclusive, the numeral 139 designates the conductive member of the screen 138, the numeral 140 designate the photoconductive member, the numeral 141 the surface insulating member, and the numeral 142 is the conductive member provided at one surface side of the screen 138. First of all, FIG. 45 indicates the simultaneous image irradiation and the primary voltage application, wherein the surface insulating member 141 is charged, for example, in the positive polarity by means of the corona wire 143. In the figure, the reference numeral 144 designates the original image to be reproduced, having therein the dark image portion D and the bright image portion L, the numeral 145 refers to the light for exposure in the arrow direction, and the numeral 146 represents the power source for the corona wire. The electric charging of the screen in the abovementioned process steps is identical with that explained in the foregoing FIG. 36, hence the repeated explanation is dispensed with.

FIG. 46 indicates a result of conducting uniform exposure over the entire surface of the screen 138 by means of the exposure light 147 in the arrow direction, whereby the photoconductive member 140 becomes low resistance value and is drawn by the static charge on the insulating member 141 with the result that the electrostatic contrast of the screen increases, thereby to form the primary electrostatic latent image.

FIG. 47 indicates the secondary electrostatic latent image forming process, in which the same principle of the ion flow modulation as mentioned in the foregoing applies. In the illustration of FIG. 47, the reference numeral 149 designates the power source for the corona wire 148, the numeral 150 designates the recording member, the numeral 151 refers to the conductive support member, the numeral 152 represents the power source for applying the bias field between the conductive member 139 and 142, and the numeral 153 represents the power source for applying the bias field between the screen 138 and the conductive support member 151. Further, the reference letter $\alpha$ designates the inhibiting field of the ion flow shown by the dotted lines, and $\beta$ designates the accelerating field.

Figure 48:
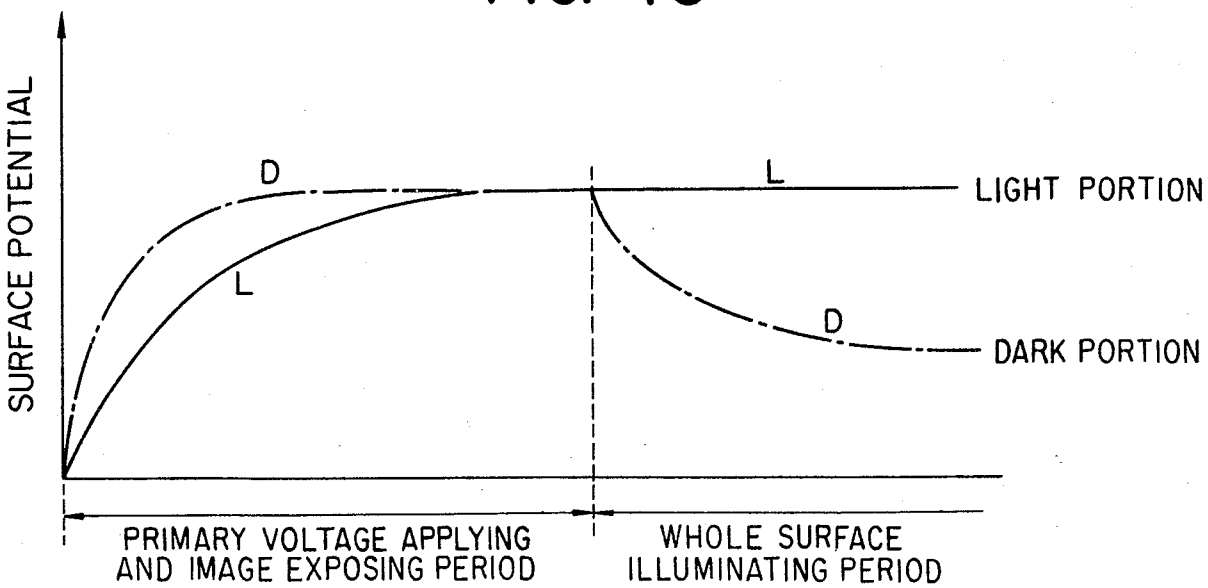
FIG. 48 is a graphical representation showing the surface potential curve of the image forming steps shown in FIGS. 46 and 47.

FIG. 48 shows the surface potential curves on the surface of the screen 138 according to the aforedescribed electrophotographic process.

Fourth Embodiment

On one surface of the conductive member as the base for the screen which is made of stainless steel wire of 30 microns in diameter in the form of a metal wire net of 200 mesh size, there is deposited selenium (Se) containing therein 5% of tellurium (Te) as the photoconductive member by the vacuum-evaporation to a thickness at the thickest portion thereof of approximately 40 microns. Thereafter, parylene (produced by Union Carbide Corporation) is coated on this photoconductive and conductive members to a thickness of approximately 10 microns. Subsequently, aluminum is deposited by evaporation to a thickness of 2,000 angstroms onto the surface side of the screen opposite to that where selenium is coated by evaporation, whereby the screen for use in the electrophotographic process according to the present invention is fabricated.

The image exposure is conducted from the surface side of the screen coated with selenium with the amount of the exposure light at the bright image portion being about 6 lux/sec. accompanied by the simultaneous primary voltage application at +6 kV. Following this simultaneous image irradiation and primary voltage application, the overall surface of the abovementioned screen is exposed to form thereon the primary electrostatic latent image having the surface potential of approximately +200 V at the dark image portion and approximately +450 V at the bright image portion. Then, the electrostatic recording paper is disposed facing the primary electrostatic latent image surface of the screen at a space interval therebetween of 3 mm. The stainless steel wire as the conductive member of the screen is earthed, the aluminum layer deposited on the screen is impressed by a voltage of +400 V, while the recording paper is impressed by a voltage of −3 kV, and the corona discharge of +7 kV is applied from the side of the aluminum layer on the screen so as to form the secondary electrostatic latent image on the recording paper. Upon formation of the secondary electrostatic latent image on the recording paper, it is developed by a liquid developing agent to obtain a clear positive image of the original. When the retention copying is conducted for 100 times using this secondary electrostatic latent image on the recording paper, the decrease in the image density in the hundredth sheet is recognized to be less than 10% with respect to the image density in the initial sheet, the reproduced image of which is found serviceable for the practical use.

This fourth embodiment of the electrophotographic process according to the present invention comprises the primary voltage application to uniformly charge the abovementioned screen, the subsequent secondary voltage application, the image irradiation following the second voltage application, and the third voltage application. In the explanations of the electrophotographic process in this embodiment, the screen to be referred to is such one that uses an N-type photoconductive body having a rectifying property, i.e., having electrons as the principal carrier.

Referring to FIGS. 49 to 66 inclusive which indicate the electrophotographic process in this fourth embodiment, the construction of the screen 154 is the same as shown in FIG. 36, and consists of the conductive member 155 to be the basic element for the screen 154, the photoconductive member 156, the surface insulating member 157, and another conductive member 158 provided at one surface side of the screen 154.

Figure 49:
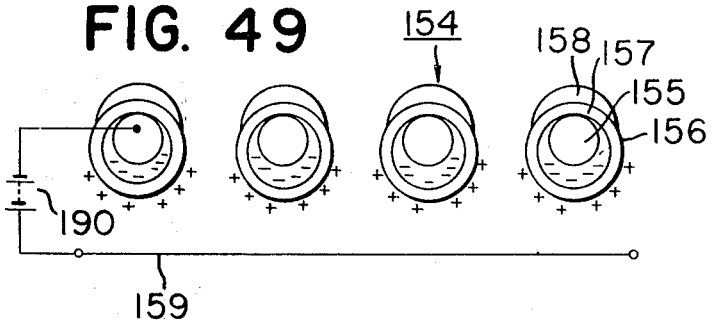
FIGS. 49 to 53 inclusive are respectively schematic diagrams to explain the forming processes of the primary electrostatic latent image on the screen.

FIG. 49 indicates the primary voltage application process, wherein the surface insulating member 157 is positively charged by the corona wire 159. By this primary voltage application, electrons are injected into the photoconductive member 156 from the conductive member 155, whereby the negative charge layer is formed in the photoconductive member 156 at the position contiguous to the insulating member 157 having the positive charge. In case the photoconductive member 156 is made of such substance as not having the rectifying property, the disposition of the electric charge as shown in FIG. 49 can be obtained by performing the uniform exposure to the photoconductive member at the time of the abovementioned primary voltage application.

Figure 50:
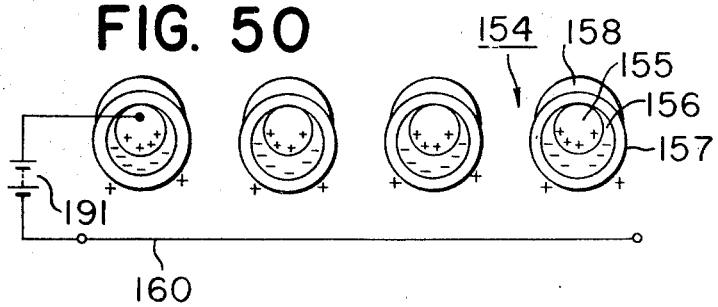

FIG. 50 shows a result of performing the secondary voltage application to the abovementioned screen 154 in the dark with a voltage having the polarity opposite to that of the primary voltage application by means of the corona wire 160 and the power source 191 therefor.

Figure 51:
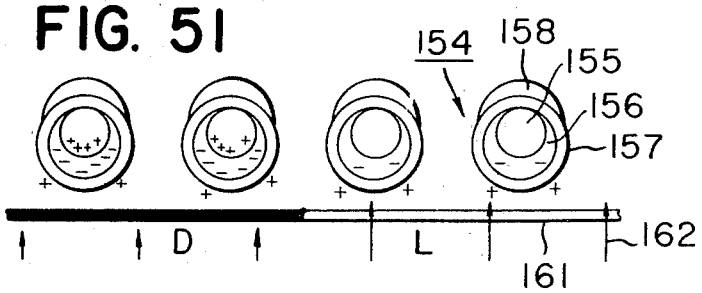

FIG. 51 indicates the image irradiation of the original image 161 onto the screen 154 with the light 162 for the exposure in the arrow direction, whereby, at the bright image portion, there takes place injection of the holes from the conductive member 155 into this bright portion of the conductive member, or release of the electrons, which have been trapped within the photoconductive member 156, into the conductive member 155 as the result of their being energized by light rays, although no change takes place at the dark image portion of the photoconductive member. As the result of this image irradiation, there is formed an electric charge couple at both sides of the insulating member 157 in the bright image portion of the screen 154.

Figure 52:
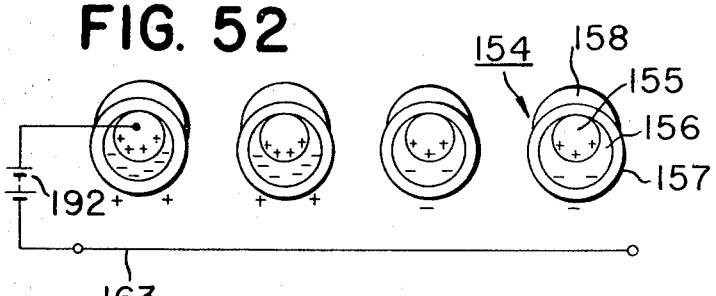

FIG. 52 indicates the tertiary voltage application by means of the corona wire 163, wherein a voltage having the same polarity as is the case with the abovementioned secondary voltage application is applied. By the application of the negative voltage, the surface potential of the screen 154 at the dark image portion varies little, while the surface potential at the bright image portion takes again the negative polarity. The abovementioned image irradiation and the tertiary voltage application can be performed almost at the same time.

Figure 53:
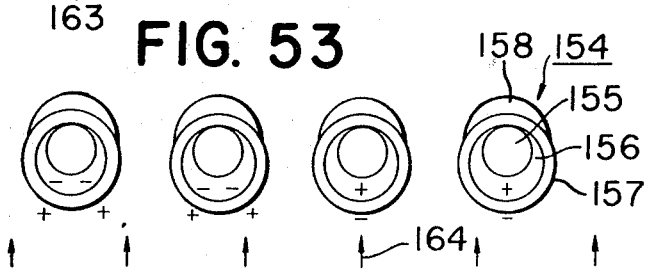

FIG. 53 indicates the total surface irradiation of the screen 154 by the exposure light 164 in the arrow direction, whereby the bright image portion of the screen 154 is negatively charged at its surface, and the dark image portion thereof is positively charged, whereby the primary electrostatic latent image of high electrostatic contrast is formed. This primary electrostatic latent image is not eliminated in the bright image portion.

Figure 54:
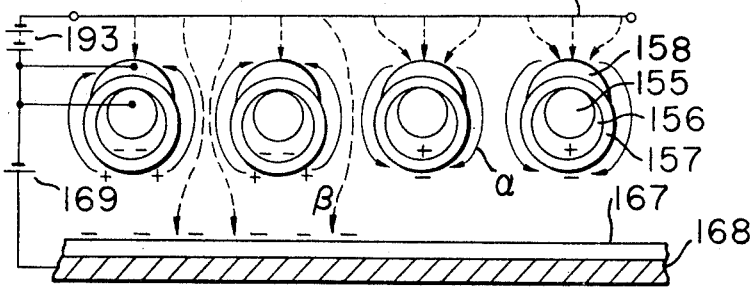
FIG. 54 is a schematic diagram to explain the forming process of the secondary electrostatic latent image by the same screen.

FIG. 54 indicates the secondary electrostatic latent image forming process, in which the same principle of the ion flow modulation as explained in the foregoing applies. In the drawing, the reference numeral 165 designate the corona wire, to which a voltage of the opposite polarity to that of the surface potential of the dark image portion is applied, the numeral 167 designates the recording member held on the conductive support member 168, the numeral 169 refers to the power source for applying the bias field between the abovementioned conductive support member 168 and the screen 154, and the dotted lines denote the flow of corona ions from the corona wire 165. Where the primary electrostatic latent image is formed by the surface potentials of mutually opposite polarity between the bright and dark image portions, no bias field is required to be applied between the conductive members 155 and 158, hence sufficient secondary electrostatic latent image can be formed even with the screen as shown in FIG. 1 which has no part corresponding to the conductive member 158 as in this embodiment. Variations in the electric potential on the screen 154 at every stage of the electrophotographic processes according to this embodiment are shown by the surface potential curves in FIG. 66.

Now, in reference to FIGS. 55 to 60 inclusive, another type of the electrophotographic process will be explained hereinbelow. In this particular process, the secondary voltage application shown in FIG. 56 and the tertiary voltage application shown in FIG. 58 are carried out by the A.C. power source.

Figure 55:
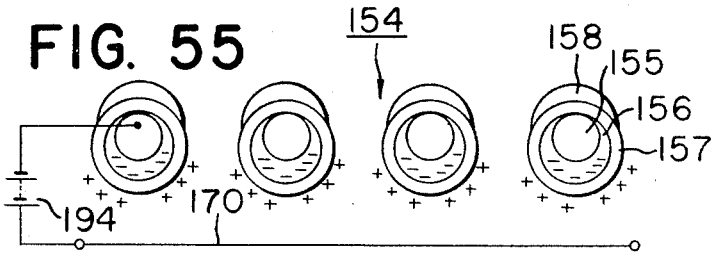
FIGS. 55 to 59 inclusive are respectively schematic diagrams to explain the forming processes of the primary electrostatic latent image on the screen.

FIG. 55 indicates the primary voltage application, wherein the screen 154 is charged in the positive polarity by the corona wire 170.

Figure 56:
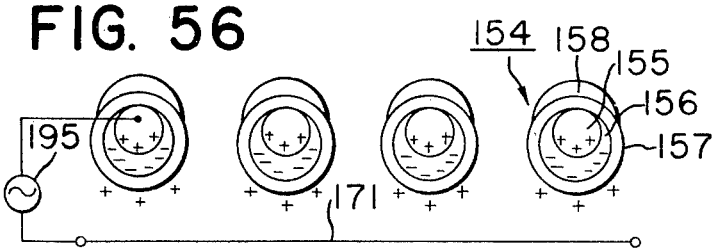

FIG. 56 shows a result of performing the secondary voltage application to the screen 154 by the corona wire 171 and the A.C. power source 195 therefor. The use of the A.C. power source, however, is inferior in the power to remove the electric charge on the insulating member 157 to the case of applying the secondary voltage as in FIG. 50 with the consequence that the disposition of the electric charge as shown in the drawing is obtained.

Figure 57:
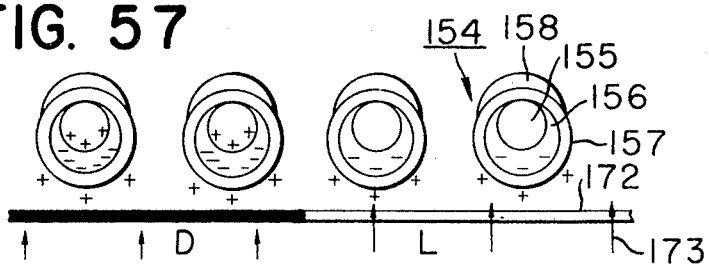
Figure 58:
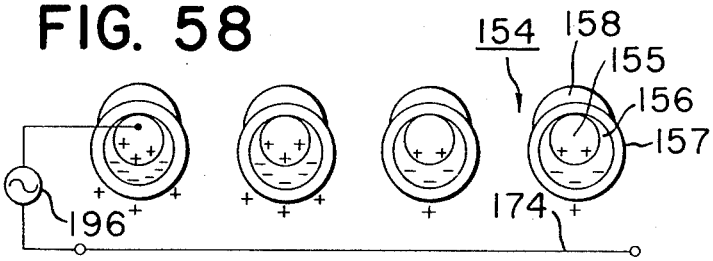

FIG. 57 indicate the image irradiation to the abovementioned screen 154, wherein the original image 172 to be reproduced is irradiated by the exposure light 173.

FIG. 58 shows a result of performing the tertiary voltage application by means of the corona wire 174 and the A.C. power source 196 therefor. Incidentally, when the primary voltage application is carried out in the positive polarity, use of the abovementioned respective A.C. power source, on which a negative current has been superposed, is also effective.

Figure 59:
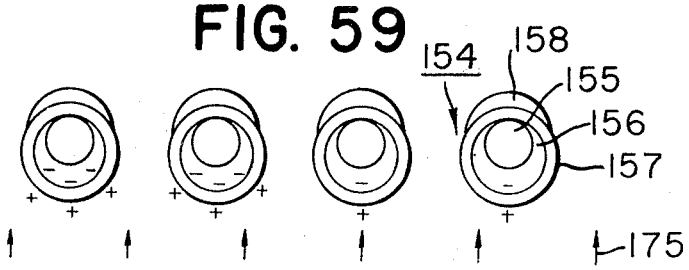

FIG. 59 shows the total surface irradiation of the screen 154, by which the secondary electrostatic latent image due to the electrostatic contrast of the same polarity is formed on the screen 154. The arrow marks 175 in this drawing designate light rays.

Figure 60:
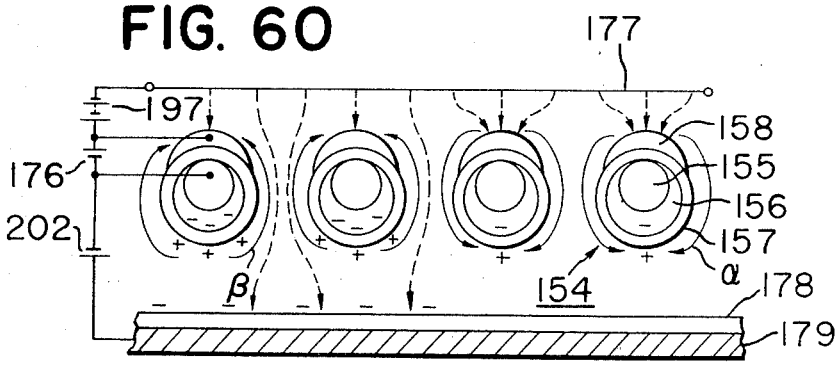
FIG. 60 is a schematic diagram to explain the forming process of the secondary electrostatic latent image by the same screen.
Figure 67:
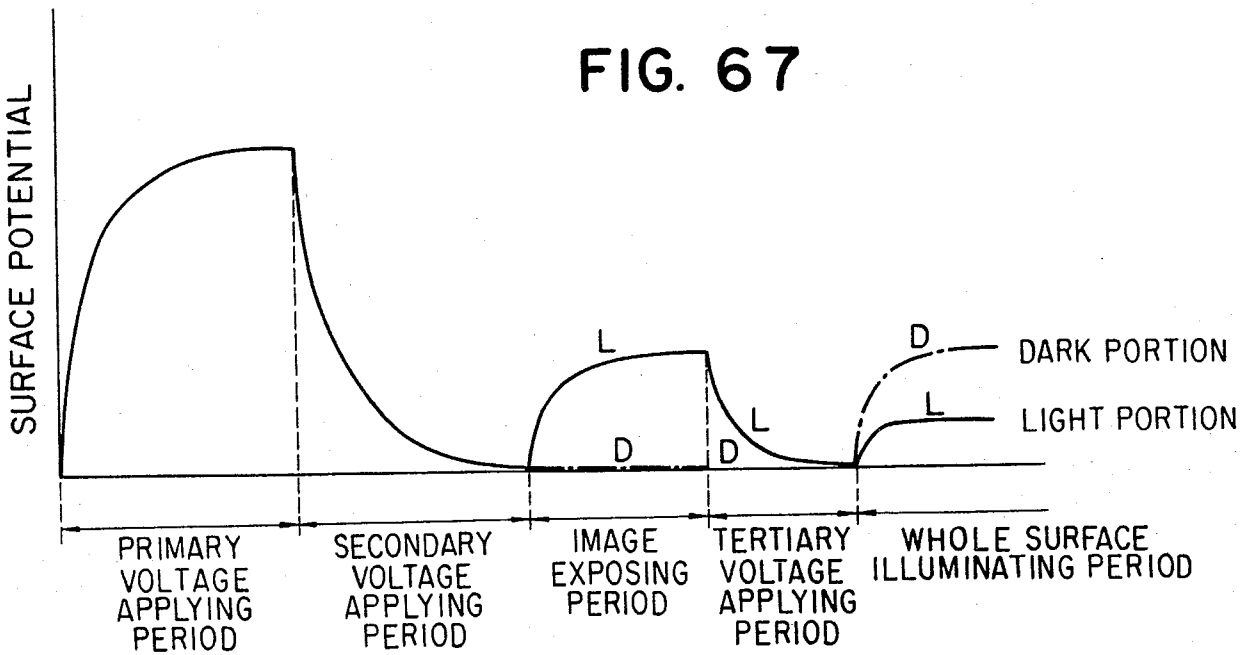
FIG. 67 is a graphical representation showing the surface potential curve of the screen in the image forming steps shown in FIGS. 55 to 59.

FIG. 60 indicates the secondary electrostatic latent image forming process onto the recording member 178 held on the conductive support member 179, in which the ion flows as shown by the dotted lines are modulated under the satisfactory conditions by impressing the voltage onto the conductive members 155 and 158 through the corona wire 177 and the power source 176 in view of the fact that the primary electrostatic latent image formed in the abovementioned member has the same polarity in both dark and bright image portions thereof. The same principle of the ion flow modulation as has been explained in reference to FIG. 5 is applicable. Variations in the surface potential on the screen 154 at every stage of the electrophotographic process according to this embodiment are shown by the surface potential curves in FIG. 67.

Referring further to FIGS. 61 to 65 inclusive, still another type of the electrophotographic process will be explained hereinbelow. In this particular process, the image irradiation shown in FIG. 51 and the tertiary voltage application shown in FIG. 52 are carried out simultaneously, and the tertiary voltage application is performed by the A.C. power source.

Figure 61:
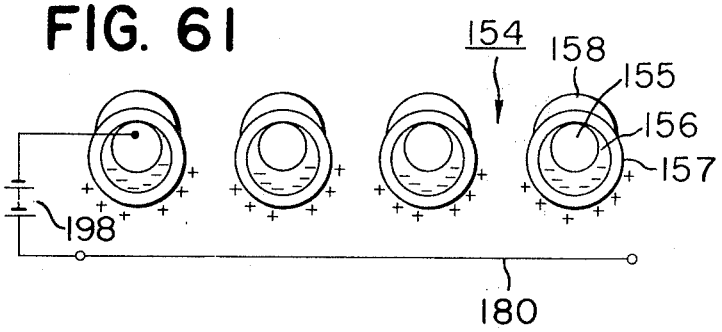
FIGS. 61 to 64 inclusive are respectively schematic diagrams to explain the forming processes of the primary electrostatic latent image on the screen.

FIG. 61 shows the primary voltage application, in which the screen 154 is positively charged by the corona wire 180.

Figure 62:
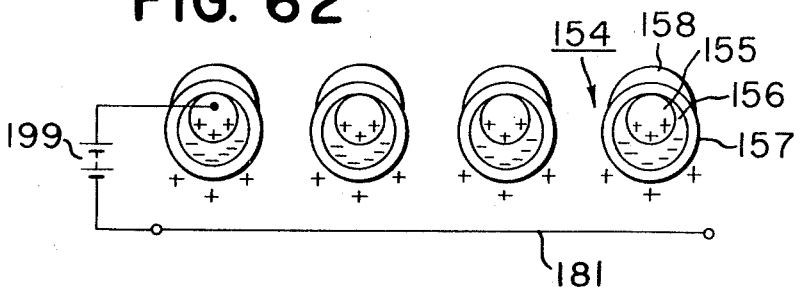

FIG. 62 shows the secondary voltage application, in which the screen 154 is charged in the opposite polarity to that in the primary voltage application by the corona wire 181.

Figure 63:
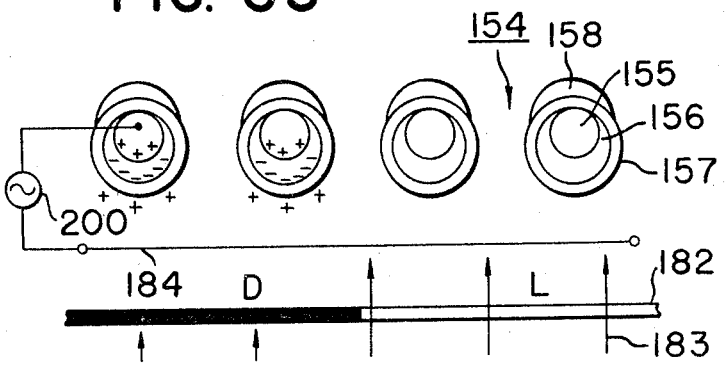

FIG. 63 indicates a result of performing the tertiary voltage application onto the screen 154 by the corona wire 184 and the A.C. power source 200, while the image irradiation is being performed simultaneously by way of the original image 182 to be reproduced and the exposure light 183.

Figure 64:
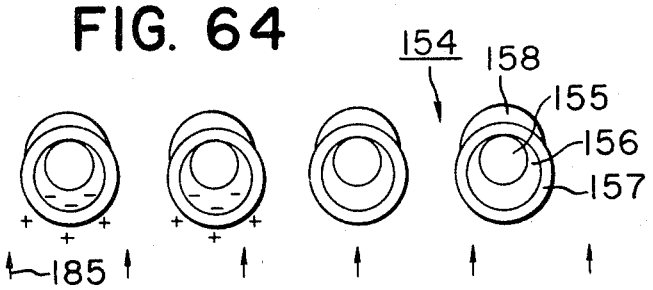

FIG. 64 indicates the result of performing the total surface irradiation to the abovementioned screen 154, whereby the primary electrostatic latent image due to the electrostatic contrast, in which the dark image portion has the same polarity as that of the primary voltage application and the bright image portion has almost zero surface potential, is formed on the screen 154. The arrow marks 185 in this drawing designate light rays.

Figure 65:
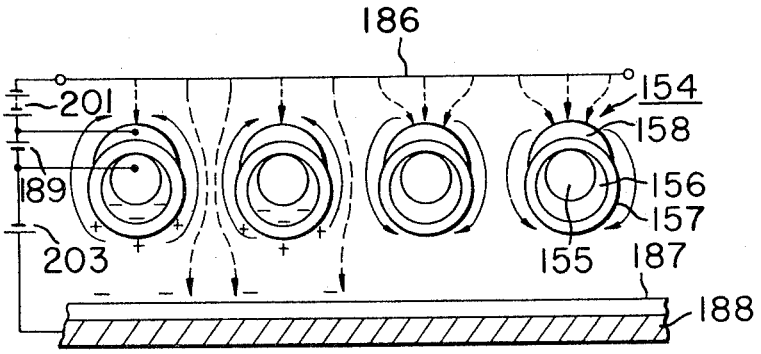
FIG. 65 is a schematic diagram to explain the forming process of the secondary electrostatic latent image by the same screen.
Figure 66:
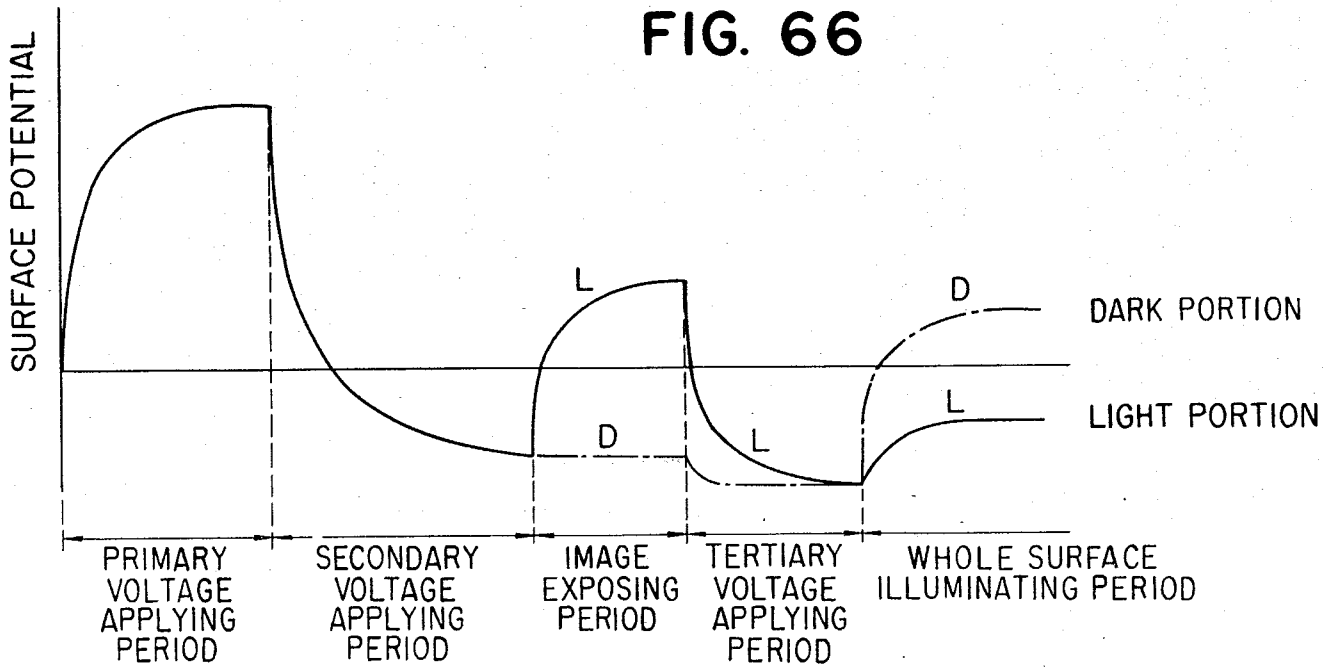
FIG. 66 is a graphical representation showing the surface potential curve of the screen in the latent image forming steps shown in FIGS. 49 to 53.
Figure 68:
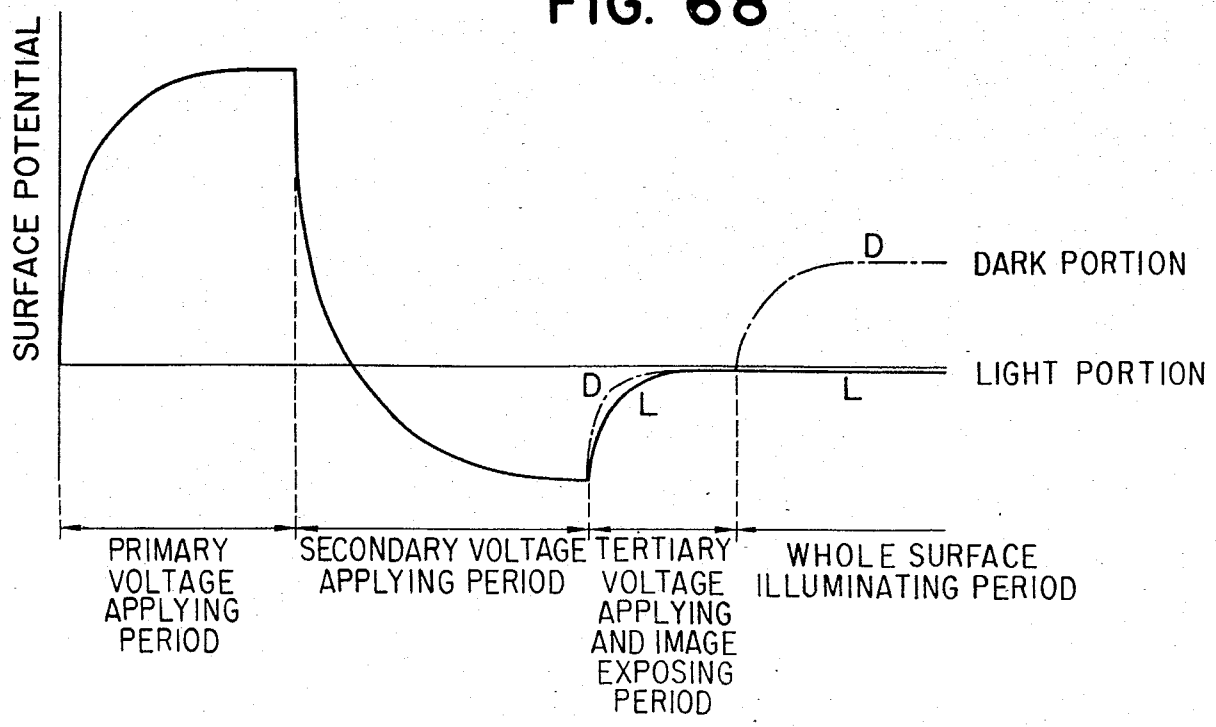
FIG. 68 is a graphical representation showing the surface potential curve of the screen in the image forming steps shown in FIGS. 61 to 64.

FIG. 65 shows the secondary electrostatic latent image forming process onto the recording member 187 held on the conductive support member 188 by means of the corona wire 186. In this secondary electrostatic latent image forming process, even if the surface potential on one surface side of the screen 154 where the primary electrostatic latent image is formed is zero, it is possible to modulate the ion flow as shown by the dotted lines in a state of being free from the fog through application of the bias field between the conductive member 155 and 158 as illustrated. The same principle of modulating the ion flow as has been described previously with reference to FIG. 5 is applicable to this embodiment. Variations in the surface potential on the screen 154 at every stage of the electrophotographic process according to this embodiment are shown by the surface potential curves in FIG. 68.

The Table in FIG. 69 shows one example of the polarity characteristic in the primary, secondary, and tertiary voltage applications in the electrophotographic process shown in FIGS. 49 to 54 inclusive, in which the primary voltage application is carried out in the positive polarity. In the Table, the symbol "AC" includes both alternating current and alternating current superposed by direct current.

In FIGS. 49 through 65, the reference numerals 190 and 201 respectively designate the power source for the corona wire, and the reference numeral 202 in FIG. 60 and the numeral 203 in FIG. 65 refer to the power source to form the bias field between the screen and the conductive support member.

In the foregoing explanations of the electrophotographic process according to the present invention, the construction of the screen has been diagrammatically shown for easiness of the understanding and explanation, hence the configuration of the screen is in no way limited to any particular one. Also, the characteristics of the photoconductive substance is not limited to those as exemplified. Further, the direction for the voltage application in the primary electrostatic latent image formation as well as the direction for the image irradiation have been described as to those which can only achieve the maximum effect, although they are not limited to these examples alone. In addition, in each process as has been exemplified, the secondary electrostatic latent image is formed on the recording member without exception. It goes without saying that this recording member may not only be the electrostatic recording paper, but also be any type of the conventionally known electrostatic latent image forming member. The photosensitive screen shown in FIG. 1 gives the best results in the electrophotographic process according to the present invention.

While the present invention has been illustrated and described by way of preferred embodiments thereof, it is to be understood that such are merely illustrative and not restrictive, and that variations and modifications may be made therein without departing from the spirit and scope of the present invention as set forth in the appended claims.

We claim:

1. A photosensitive perforate screen comprising:

an electrically conductive base having a plurality of fine openings;

a photoconductive layer formed on said base; and an insulating layer, capable of supporting an electric charge, formed on said photoconductive layer;

wherein one side of said screen includes a conductive outer surface, while said insulating layer defines the outer surface at least on the opposite side of said screen and extends continuously therefrom to the inside peripheries of the screen openings, and wherein said insulating layer is capable of retaining electric charges of opposite polarities on the opposite sides thereof even when exposed to light.

2. A screen according to claim 1, wherein said conductive outer surface is an exposed portion of said conductive base.

3. A screen according to claim 1, wherein said conductive outer surface is a separate conductive member formed on a portion of said insulating layer on said one side of said screen.

4. A screen according to claim 3, wherein said photoconductive layer surrounds the entire conductive base and wherein said insulating layer surrounds the entire photoconductive layer.

5. A screen according to claim 1, wherein said conductive outer surface is defined by alternate portions of said conductive base which are exposed on said one side, the remaining portions of said conductive base being covered by said insulating layer.

6. A screen according to claim 1, further comprising an additional insulating layer between said conductive base and said photoconductive layer.

7. A screen according to claim 1, wherein most of said photoconductive layer is on one side of said conductive base.

8. A screen according to claim 1, wherein the thickness of each of said insulating and photoconductive layers is the greatest at said opposite side of said screen and decreases progressively toward said one side thereof.

9. A photosensitive perforate screen comprising:

an electrically conductive base having a plurality of fine openings;

a photoconductive layer formed on said base; and an insulating layer, capable of supporting an electric charge, formed on said photoconductive layer;

wherein one side of said screen includes a conductive outer surface while said insulating layer defines the outer surface at least on the opposite side of said screen, and wherein said insulating layer is capable of retaining electric charges of opposite polarities on the opposite sides thereof even when exposed to light.

* * * * *

UNITED STATES PATENT AND TRADEMARK OFFICE

CERTIFICATE OF CORRECTION

PATENT NO. : 4,332,876

DATED : June 1, 1982

INVENTOR(S) : KATSUNOBU OHARA, ET AL.

It is certified that error appears in the above-identified patent and that said Letters Patent is hereby corrected as shown below:

Column 1, line 49, "the" should read --of--.

Column 10, line 68, "is" should read --in--.

Column 13, line 51, "seconary" should read --secondary--.

Column 17, line 37, "steps" should read --stops--.

Column 19, line 58, "disposed" should read --dispensed--.

Column 20, line 4, insert -- . -- after "66";
line 5, delete "of the conductive member 66."

Column 25, line 47, "404" should read --401--;
line 49, "103" should read --403--, Column 27, line 23, "indicate" should read --indicates--.

Column 28, line 32, "designate" should read --designates".

Column 30, line 64, "-ignate" should read --ignates--.

UNITED STATES PATENT AND TRADEMARK OFFICE

CERTIFICATE OF CORRECTION

PATENT NO. : 4,332,876

DATED : June 1, 1982

INVENTOR(S) : KATSUNOBU OHARA, ET AL.

It is certified that error appears in the above-identified patent and that said Letters Patent is hereby corrected as shown below:

Column 31, line 34, "indicate" should read --indicates--;
line 57, "member" should read --manner--

Signed and Sealed this

*Fourteenth* Day of *December 1982*

[SEAL]

*Attest:*

GERALD J. MOSSINGHOFF

*Attesting Officer*

*Commissioner of Patents and Trademarks*